US010152917B2

(12) United States Patent
Chung

(10) Patent No.: US 10,152,917 B2
(45) Date of Patent: Dec. 11, 2018

(54) ORGANIC LIGHT-EMITTING DISPLAY APPARATUS, METHOD OF REPAIRING THE SAME USING REPAIR LINES AND DUMMY PIXELS, AND METHOD OF DRIVING THE SAME

(71) Applicant: SAMSUNG DISPLAY CO., LTD., Yongin, Gyeonggi-Do (KR)

(72) Inventor: Kyung-Hoon Chung, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 548 days.

(21) Appl. No.: 14/325,760

(22) Filed: Jul. 8, 2014

(65) Prior Publication Data

US 2015/0130787 A1 May 14, 2015

(30) Foreign Application Priority Data

Nov. 8, 2013 (KR) ..... 10-2013-0135841

(51) Int. Cl.
*G09G 3/3225* (2016.01)

(52) U.S. Cl.
CPC ... *G09G 3/3225* (2013.01); *G09G 2300/0413* (2013.01); *G09G 2300/0842* (2013.01); *G09G 2330/08* (2013.01); *G09G 2330/10* (2013.01)

(58) Field of Classification Search
CPC ..... G09G 3/30–3/3291; G09G 2300/0413; G09G 2330/08; G09G 2330/10
See application file for complete search history.

(56) References Cited

U.S. PATENT DOCUMENTS 6,388,925 B1 5/2002 Kim
8,330,691 B2 * 12/2012 Tanimoto ..... G02F 1/136286 345/92
9,129,923 B1 * 9/2015 Han ..... H01L 27/3248
2004/0263745 A1 * 12/2004 Lee ..... G02F 1/134309 349/139
2009/0225009 A1 * 9/2009 Ka ..... G09G 3/3233 345/76
2009/0231255 A1 * 9/2009 Tanimoto ..... G02F 1/136286 345/87
2009/0284679 A1 * 11/2009 Kim ..... G02F 1/1309 349/54
2011/0032442 A1 * 2/2011 van Aerle ..... G02F 1/136259 349/38

(Continued)

FOREIGN PATENT DOCUMENTS

KR 2001-0005226 1/2001
KR 10-0363085 11/2002

(Continued)

*Primary Examiner* — Yuzhen Shen
(74) *Attorney, Agent, or Firm* — Lee & Morse, P.C.

(57) ABSTRACT

An organic light-emitting display apparatus includes a plurality of emission pixels, a plurality of dummy pixels, and a plurality of repair lines. The emission pixels are aligned in column and row directions in an active region. The dummy pixels are in a dummy region. The repair lines are connected to at least one of the at least one sub-emission pixel or at least one of the dummy pixels. Each emission pixel includes at least one sub-emission pixel. At least two sub-emission pixels aligned in a column or row direction are alternately connected to two repair lines.

21 Claims, 15 Drawing Sheets

(56) References Cited

U.S. PATENT DOCUMENTS

2012/0092579 A1* 4/2012 Liu ..... G09G 3/20 349/55
2012/0127221 A1* 5/2012 Tamaki ..... G09G 3/3233 345/691
2013/0176194 A1* 7/2013 Jin ..... G09G 3/3233 345/76
2014/0292827 A1* 10/2014 Kang ..... G09G 3/20 345/690
2014/0346475 A1* 11/2014 Cho ..... H01L 27/326 257/40
2014/0347401 A1* 11/2014 Hwang ..... G09G 3/3233 345/690
2015/0022513 A1* 1/2015 Kim ..... G09G 3/3225 345/212
2015/0102312 A1* 4/2015 Lee ..... G09G 3/3233 257/40
2015/0108437 A1* 4/2015 Cho ..... H01L 27/3248 257/40
2015/0109189 A1* 4/2015 Hwang ..... G09G 3/3225 345/78
2015/0123884 A1* 5/2015 Kim ..... G09G 3/006 345/77
2015/0161931 A1* 6/2015 Lee ..... G09G 3/3266 345/77
2015/0170562 A1* 6/2015 In ..... G09G 3/3258 345/80
2015/0243214 A1* 8/2015 Jeong ..... G09G 3/3233 345/214
2016/0163243 A1* 6/2016 Park ..... G09G 3/3258 345/205

FOREIGN PATENT DOCUMENTS

KR 10-0666639 B1 * 1/2007 ..... G09G 3/30
KR 10-0932989 B1 12/2009

* cited by examiner

ORGANIC LIGHT-EMITTING DISPLAY APPARATUS, METHOD OF REPAIRING THE SAME USING REPAIR LINES AND DUMMY PIXELS, AND METHOD OF DRIVING THE SAME

CROSS-REFERENCE TO RELATED APPLICATION

Korean Patent Application No. 10-2013-0135841, filed on Nov. 8, 2013, and entitled, "Organic Light Emitting Display Apparatus, Method of Repairing the Same, and Method of Driving the Same," is incorporated by reference in its entirety.

BACKGROUND

1. Field

One or more embodiments described herein relate to a display device, and a method of driving and repairing a display device.

2. Description of the Related Art

If a certain pixel is defective, the pixel may emit light all the time regardless of a scan signal and a data signal. A pixel that emits light all the time may be considered as creating a bright spot on the screen. A bright spot has high visibility, and thus is easily recognized by a user. Attempts have been made to correct this problem. One attempt involves controlling the defective pixel to produce a limited amount of light, thereby producing a dark spot. However, as pixel circuits become increasingly more complex, it is difficult to take this course of action in correcting defective pixels.

SUMMARY

In accordance with one embodiment, an organic light-emitting display apparatus includes a plurality of emission pixels aligned in column and row directions in an active region, each of the emission pixels including at least one sub-emission pixel; a plurality of dummy pixels in a dummy region; and a plurality of repair lines connected to at least one of the at least one sub-emission pixel or at least one of the dummy pixels, wherein at least two sub-emission pixels aligned in a column or row direction are alternately connected to two repair lines.

At least one of the dummy pixels may be in each column, at least one of the repair lines may be provided for each column, and the organic light-emitting display apparatus may include at least one dummy scan line in the dummy region and connected to the at least one of the dummy pixels.

The repair lines may include a first repair line corresponding to a first column, and a second repair line corresponding to a second column adjacent to the first column, wherein at least two sub-emission pixels aligned in the first column are alternately connected to the first repair line and the second repair line.

A number of the dummy pixels may be at least one more than a number of columns of the at least one sub-emission pixel, and at least one of the plurality of repair lines may be provided for each of the dummy pixels.

The at least one sub-emission pixel may be connected to a scan line and a data line, and the dummy pixels may be connected to a dummy scan line and the data line. The dummy scan line may be in the dummy region and connected to the dummy pixel in each column, and the dummy scan line may provide a dummy scan signal to the dummy pixel with a predetermined time difference from a scan signal provided to the emission pixels in the active region.

The data line may provide a same data signal to the dummy pixel as a data signal provided to the sub-emission pixel connected to the dummy pixel via the repair line, and the data line may provide the same data signal at a timing when the dummy scan signal is provided to the dummy pixel.

At least one outermost dummy pixel in an outermost portion among the plurality of dummy pixels may be connected to a dummy data line and may receive a data signal from the dummy data line. The dummy data line connected to the at least one outermost dummy pixel may provide a same data signal to the at least one outermost dummy pixel as a data signal provided to the sub-emission pixel connected to the dummy pixel, at a timing when a dummy scan signal is provided to the at least one outermost dummy pixel.

The at least one sub-emission pixel may include an emission pixel circuit connected to an emission device, the dummy pixels may include a dummy pixel circuit, and the repair lines may connect the emission device of the at least one sub-emission pixel, in which the emission pixel circuit and the emission device are separated from each other, with the dummy pixel circuit of the dummy pixels. The dummy pixel circuit may be same as the emission pixel circuit.

The emission pixel circuit may include a first transistor to transmit a data signal in response to a scan signal; a capacitor to store a voltage corresponding to the transmitted data signal; and a second transistor to transmit a driving current corresponding to the voltage stored in the capacitor to the emission device.

The emission device may include an emission layer between an anode and a cathode, and a wiring connecting the emission pixel circuit and anode of the emission device of the sub-emission pixel connected to the repair line may be disconnected.

Each of the dummy pixels includes at least one sub-dummy pixel, and the repair lines may connect one of the at least one sub-emission pixel and one of the at least one sub-dummy pixel. Each of the dummy pixels may include a same number of sub-dummy pixels as the sub-emission pixels.

The dummy region may be arranged in at least one of an upper side or a bottom side of the active region. The emission pixels may simultaneously emit light. At least one insulating layer may be between a first conductive unit and the repair line, and may be between a second conductive unit and the repair line, wherein.

The first conductive unit may contact an anode of an emission device of the sub-emission pixel connected to the repair line. The second conductive unit may contact a dummy pixel circuit of the dummy pixel connected to the repair line. The first conductive unit may be electrically connected to the repair line, and the second conductive unit may be electrically connected to the repair line.

In accordance with another embodiment, a method for repairing an organic light-emitting display apparatus includes disconnecting an emission device and an emission pixel circuit of a first defective pixel and a second defective pixel in a first column; connecting a first repair line corresponding to the first column with the emission device of the first defective pixel; connecting a second repair line, corresponding to a second column adjacent to the first column, to the emission device of the second defective pixel; and connecting a dummy pixel circuit of one of a plurality of dummy pixels to the repair line, wherein a same data signal provided to the defective pixel connected to the repair line is provided to the dummy pixel, and wherein a driving current corresponding to the data signal is provided to the emission device of the defective pixel via the repair line.

At least one sub-emission pixel may include a conductive unit connected to the at least one sub-emission pixel and overlapping the repair line, with at least one insulating layer interposed between the conductive unit and the repair line, and conductive units of at least two sub-emission pixels may be aligned in a column or row direction among the at least one sub-emission pixel alternately overlap two repair lines.

The conductive unit in the at least one sub-emission pixel may be connected to an anode of the emission device of the sub-emission pixel, and the method may include connecting of the first defective pixel includes electrically connecting a conductive unit of the first defective pixel and the first repair line, and connecting the second defective pixel includes electrically connecting a conductive unit of the second defective pixel and the second repair line.

Each of the dummy pixels may include a conductive unit overlapping the repair line, with at least one insulating layer between the conductive unit and the repair line, and the method may include connecting of the dummy pixels includes electrically connecting the conductive unit of the each of the dummy pixels and the repair line.

The method may include connecting the conductive units and the repair lines includes electrically connecting the conductive units and the repair lines by destroying a portion of the insulating layers interposed between the conductive units and repair lines.

In accordance with another embodiment, a display device includes a first repair line; a second repair line; a first dummy pixel circuit; a second dummy pixel circuit; a sequence of first emission pixels; and a sequence of second emission pixels, wherein the first dummy pixel circuit is connected to a first data line, which is connected to a first one of the first emission pixels, the second dummy pixel circuit is connected to a second data line, which is connected to a first one of the second emission pixels, and the first repair line is to connect the first dummy pixel circuit to the first one of the first emission pixels and the second repair line is to connect the second dummy pixel circuit to a second one of the first emission pixels.

The sequence of first emission pixels may be arranged in a first column, and the sequence of second emission pixels may be arranged in a second column. The display device may include a select line to connect the second dummy pixel circuit to the second one of the first emission pixels.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
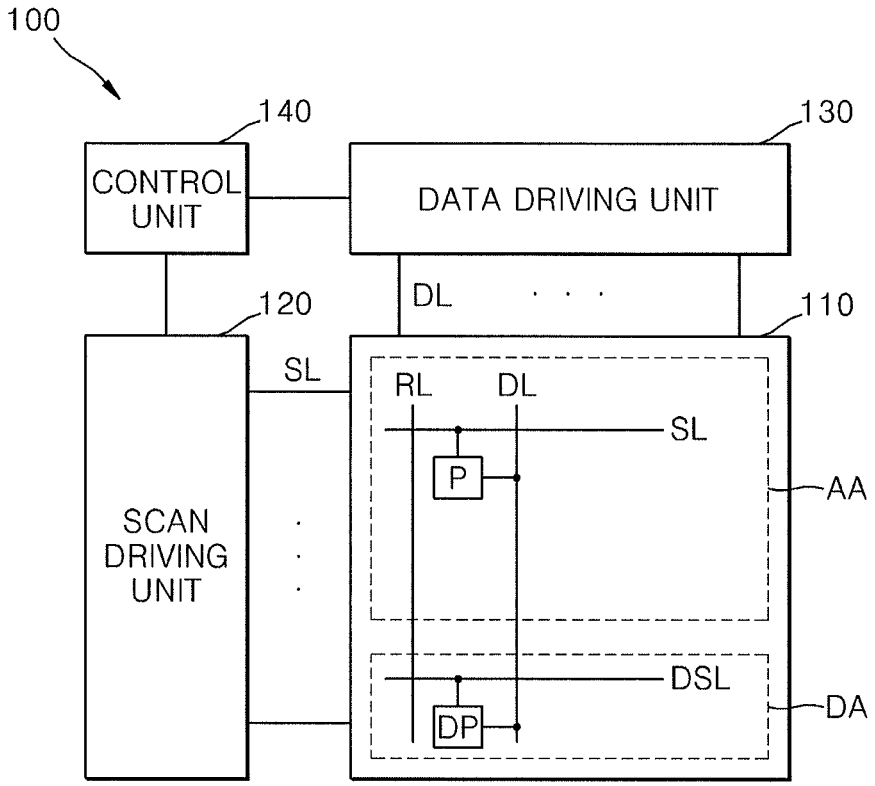
FIG. 1 illustrates an embodiment of a display apparatus.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a display apparatus 100 which includes a display panel 110, a scan driving unit 120, a data driving unit 130, and a control unit 140. The scan driving unit 120, data driving unit 130, and control unit 140 may be formed on different semiconductor chips or may be integrated on one semiconductor chip. Also, the scan driving unit 120 may be formed on the same substrate as the display panel 110, but this is not necessary.

A dummy region DA may be formed around an active region AA on the display panel 110. The dummy region DA may be formed in at least one of an upper side or a bottom side of the active region AA. A plurality of emission pixels P are arranged in the active region AA. At least one dummy pixel DP is arranged in the dummy region DA. The emission pixels P are connected to scan lines SL and data lines DL. The at least one dummy pixel DP is connected to a dummy scan line DSL and data line DL. The emission pixels P are aligned in column and row directions.

The emission pixel P may include at least one sub-emission pixel. The display panel 110 may include at least one repair line RL, which, for example, may be parallel to the data line DL in each column. The repair line RL may connect the emission pixel P and dummy pixel DP. The repair line RL may connect the sub-emission pixel and dummy pixel DP.

The scan driving unit 120 may generate and provide scan signals via a plurality of scan lines SL to the emission pixel P and dummy pixel DP. For example, the scan driving unit 120 may generate and sequentially provide scan signals, via the scan lines SL, to the emission pixels P and dummy pixel DP. The scan lines SL include a dummy scan line DSL. The dummy scan line DSL is included in the dummy region DA and is connected to the dummy pixel DP. The dummy scan line DSL provides the scan signals to the dummy pixel DP.

The data driving unit 130 may provide data signals, via a plurality of data lines DL, to the emission pixels P and the dummy pixel DP. For example, the data driving unit 130 may sequentially provide data signals to the emission pixels P and the dummy pixel DP via the data lines DL. The data driving unit 130 may transform image data, DATA input from control unit 140 and having a gray scale value, into a voltage or current data signal.

The control unit 140 generates and transmits a scan control signal SCS and a data control signal DCS, respectively, to the scan driving unit 120 and data driving unit 130. Accordingly, the scan driving unit 120 sequentially provides scan signals to the scan lines SL, and the data driving unit 130 provides data signals to the pixels P. The timing of when a dummy scan signal is provided to the dummy scan line DSL may be different from the timing of when the scan signal is provided to the scan line SL of an emission pixel P. For example, the dummy scan signal may be provided to the dummy scan line DSL with a predetermined time difference from the scan signal provided to the emission pixel P.

The data driving unit 130 may provide data signals to the dummy pixel DP, for example, by synchronizing the data signals with dummy scan signals. Accordingly, the dummy pixel DP may receive the same data signals as data signals provided to a repaired emission pixel P from the data driving unit 130.

In FIG. 1, the data line DL is disposed in a right portion and the repair line RL is disposed in a left portion with respect to the pixel P. In other embodiments, the data and repair line DL and RL may be exchanged in position or may arranged at other locations. In one embodiment, the repair line RL may be parallel to the scan line SL according to a design of the pixel, but this is not necessary. Also, one or more repair lines RL may be formed in each column of the pixels P.

The display panel 110 may also include a plurality of emission control lines providing emission control signals, an initialization voltage line providing an initialization voltage, and a driving voltage line providing a power voltage. A first power voltage ELVDD, a second power voltage ELVSS, an emission control signal EM, and an initialization voltage Vint may be provided to the pixels P under a control of the control unit 140.

The display apparatus may be controlled by various emission methods. Examples include a simultaneous emission method in which a plurality of emission pixels simultaneously emit light, and a sequential emission method in which a plurality of emission pixels sequentially emit light. The following embodiments are illustratively described for the simultaneous emission method. However, other embodiments may be driving using a sequential emission method, for example, according to a wiring design of dummy region DA and control performed by the control unit 140.

Figure 2:
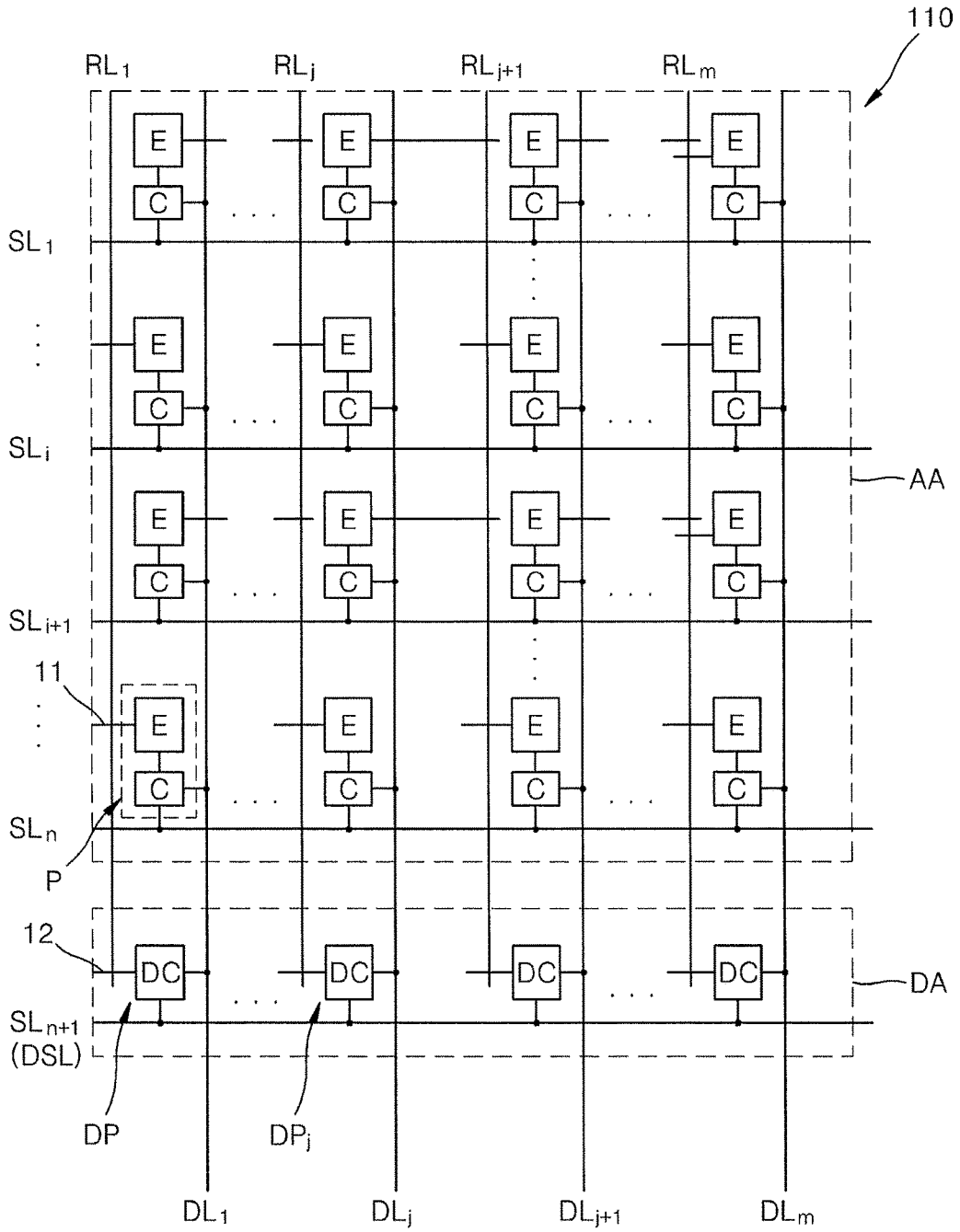
FIG. 2 illustrates an embodiment of a display panel in FIG. 1.

FIG. 2 illustrates one embodiment of display panel 110 which includes active region AA for displaying an image by emission and dummy region DA located around active region AA. In FIG. 2, the dummy region DA is formed at a bottom side of the active region AA. In other embodiments, the dummy region DA may be at a different location. At least one dummy pixel DP in the dummy region DA may be provided for each column.

The scan lines SL1 through SLn and the data lines DL1 through DLm are arranged in active region AA. The emission pixels P are aligned in approximately a matrix shape in a portion where the scan lines SL1 through SLn and the data lines DL1 through DLm cross each other. The emission pixel P may include at least one sub-emission pixel. FIG. 2 illustrates a case in which the emission pixel P includes one sub-emission pixel, that is, the emission pixel P is the sub-emission pixel. In other embodiments, the emission pixel may not have a sub-emission pixel or may have a sub-emission pixel different from that shown in FIG. 2.

The emission pixel P includes an emission pixel circuit C and an emission device E. The emission device E receives a driving current from emission pixel circuit C and emits light. The emission pixel circuit C may include at least one thin film transistor (TFT) and at least one capacitor. The emission device E may be, for example, an organic light-emitting device (OLED) that includes an emission layer between an anode and a cathode.

The emission pixel P may emit color light. For example, the emission pixel P may emit one of red, blue, green, or white colors. In other embodiments, the emission pixel P may emit a different color, e.g., yellow.

The repair lines RL1 through RLm are formed to be parallel to and spaced from the data lines DL1 through DLm. The repair lines may be arranged relative to respective columns. The emission device E of the emission pixel P may be insulated from the repair line RL in a same column. Thus, when undergoing a repair operation, the emission device E may be electrically connected to the repair line RL. For example, the emission device E may be electrically connected to a first connecting member 11, and the first connecting member 11 may partially overlap repair line RL. An insulating layer may be interposed between the first connecting member 11 and the repair line RL.

The first connecting member 11 may include at least one layer formed of a conductive material. During repair, when a laser is irradiated onto the overlapping region of the first connecting member 11 and repair line RL, the insulating layer may be destroyed. As a result, the first connecting member 11 and the repair line RL may be electrically connected and thus shorted. Accordingly, the emission device E may be electrically connected with the repair line RL.

The dummy region DA may be formed in at least one of an upper side or a bottom side of active region AA. Also, at least one dummy pixel DP may be formed in each column of the pixel. FIG. 2 illustrates a case in which dummy region DA is formed in the bottom side of active region AA, and one dummy pixel DP is formed in each column of the pixel.

At least one dummy scan line DSL and the data lines DL1 through DLm are arranged in dummy region DA. Also, the dummy pixels DP connected to the dummy scan line DSL and the data lines DL1 through DLm is included in the dummy region DA. The dummy scan line DSL is connected to dummy pixel DP. The repair lines RL1 through RLm and the data lines DL1 through DLm of the active region AA are arranged in each column. The dummy pixel DP and an emission pixel P in the same column may share a data line DL and the repair line RL in the same column.

The dummy pixel DP includes a dummy pixel circuit DC. The dummy pixel DP may further include the emission device according to various embodiments herein. When the dummy pixel DP includes the emission device, the emission device may not actually emit light, but rather may serve as a circuit device. For example, the emission device may function as a capacitor. Hereinafter, the embodiments are described for the case in which dummy pixel DP includes only the dummy pixel circuit DC. In other embodiments, the structure of the dummy pixel DP may be different.

The dummy pixel circuit DC may include at least one TFT and at least one capacitor. The dummy pixel circuit DC may be the same as or different from the emission pixel circuit C. For example, dummy pixel circuit DC of the dummy pixel DPj (corresponding to a $j^{th}$ (j=1, . . . , m, m=natural number) column) may be the same as the pixel circuit C of emission pixel P in the $j^{th}$ column. Alternatively, the dummy pixel circuit DC may omit and/or add the transistor and/or capacitor of the emission pixel circuit C. In this case, the transistor and capacitor may differ in size and characteristic, but this is not necessary.

The dummy pixel circuit DC may be insulated from the repair line RL in the same column. During repair, the dummy pixel circuit DC may be electrically connected to the repair line RL. For example, the dummy pixel circuit DC may be electrically connected to a second connecting member 12. The second connecting member 12 may be formed to partially overlap the repair line RL, with an insulating layer interposed between the second connecting member 12 and the repair line RL. The second connecting member 12 may include at least one layer formed of a conductive material, e.g., similar to the first connecting member 11. During repair, when a laser is irradiated onto the overlapping area of the second connecting member 12 and the repair line RL, the insulating layer is destroyed. As a result, the second connecting member 12 and the repair line RL may be electrically connected and thus shorted. Accordingly, the dummy pixel circuit DC may be electrically connected to the repair line RL.

Referring to FIG. 2, a plurality of emission pixels P consecutively aligned in a column direction may be alternately connected to two different repair lines RL. For example, the emission pixels P aligned in the $j^{th}$ (j=1, . . . , m, m is a natural number) column may be alternately connected to a first repair line RLj corresponding to the $j^{th}$ column and a second repair line RLj+1 corresponding to a j+1th column, sequentially. Accordingly, even if the emission pixels P are aligned in a same column, adjacent emission pixels P may be connected to different repair lines RL. For example, the emission pixel Pij connected to an $i^{th}$ (i=1, . . . , n, n=natural number) scan line SLi among the emission pixels P in the $j^{th}$ column may be connected to the first repair line RLj. The emission pixel Pi+1, j connected to an $i+1^{th}$ scan line SLi+1 may be connected to the second repair line RLj+1.

FIG. 2 illustrates a case in which the repair line RL is formed in the column direction. In other embodiments, the repair line RL may be formed in a row direction. In this case, the emission pixels P consecutively aligned in the row direction may be alternately connected to two different repair lines that are included in each row.

In one embodiment, the emission pixels P in a column may be connected to two repair lines. When the emission pixels P are formed in first through $m^{th}$ columns and the number of the repair lines is m, the emission pixels P in any one column may be all connected to one repair line RL, as illustrated in FIG. 2.

Also, referring to FIG. 2, the emission pixels P in the $m^{th}$ column may all be connected to an $m^{th}$ repair line RLm. In other embodiments, the emission pixels P in the first column may all be connected to the first repair line RL1.

Figure 3:
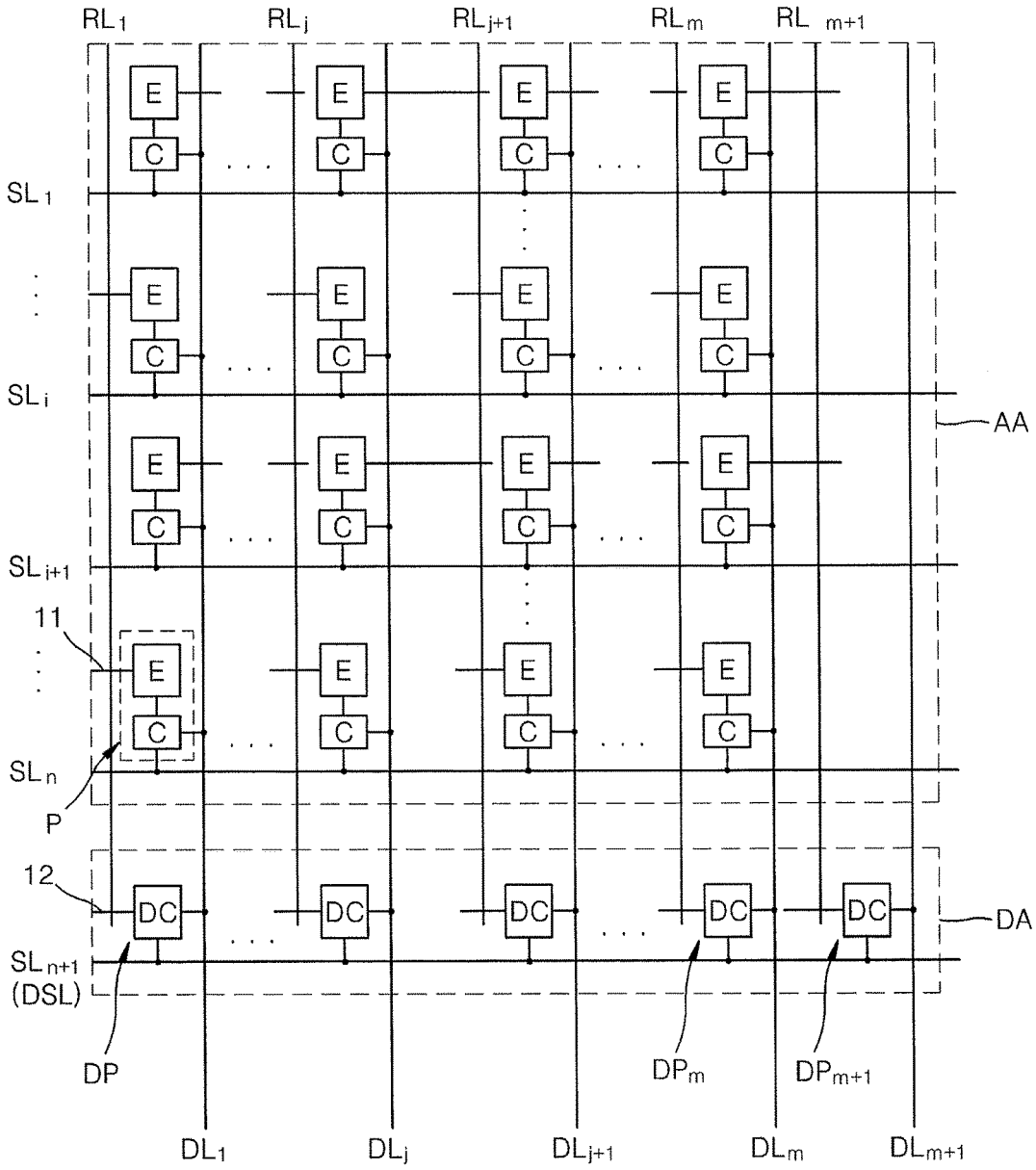
FIG. 3 illustrates another embodiment of a display panel in FIG. 1.

FIG. 3 illustrates another embodiment of the display panel illustrated in FIG. 1. In this embodiment, a dummy column including at least one dummy pixel DP may be included in an outer portion of at least one of the initial column (the first column) and the last column (the $m^{th}$ column).

Referring to FIG. 3, dummy column m+1 and dummy pixel DPm+1 corresponding to the dummy column m+1 are included in an outer portion of the $m^{th}$ column. Accordingly, the number of the dummy pixels DP included may be at least one more than the number of columns (m) of the sub-emission pixel, e.g., the number of the dummy pixels DP included may be m+1. In one embodiment, in addition to the dummy pixels DP in each column, one more dummy pixel DPm+1 may be further included in an outward direction of the outermost column (the first column or the $m^{th}$ column). At least one repair line RL is arranged in each dummy pixel DP. The repair line RLm+1 is arranged in the dummy pixel DPm+1.

Referring to FIG. 3, the dummy pixel DPm+1 may be further included in the dummy region DA. The repair line RLm+1 corresponding to the dummy pixel DPm+1 may be further included in active region AA or outside of active region AA. Accordingly, the emission pixels P are formed in the first through $m^{th}$ column. The number of the repair lines RL included may be m+1. A dummy data line DLm+1 providing data signals to the dummy pixel DPm+1 may be further included in the active region AA or outside of active region AA. The dummy data line DLm+1 is not connected to the emission pixels P and receives the data signals from the data driving unit 130.

When the dummy pixel DPm+1 is used to repair a predetermined sub-emission pixel, the dummy data line DLm+1 may provide to the dummy pixel DPm+1 a data signal which is the same as a data signal provided to the sub-emission pixel connected to the dummy pixel DPm+1, at a time when the scan signal is provided to the dummy pixel DPm+1. According to the embodiment illustrated in FIG. 3, the emission pixels P in each column may be alternately connected to two different repair lines RL.

Figure 4:
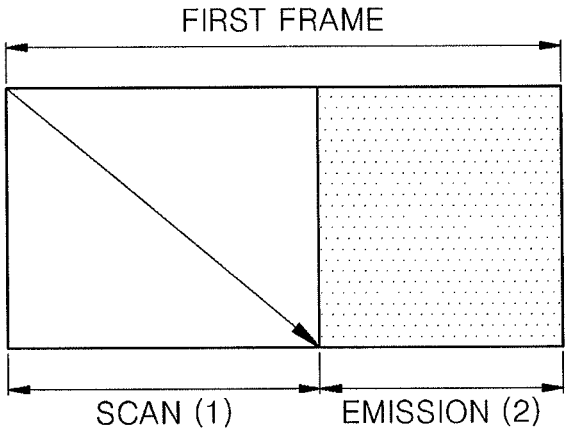
FIGS. 4 and 5 illustrates operations for driving the display apparatus.
Figure 5:
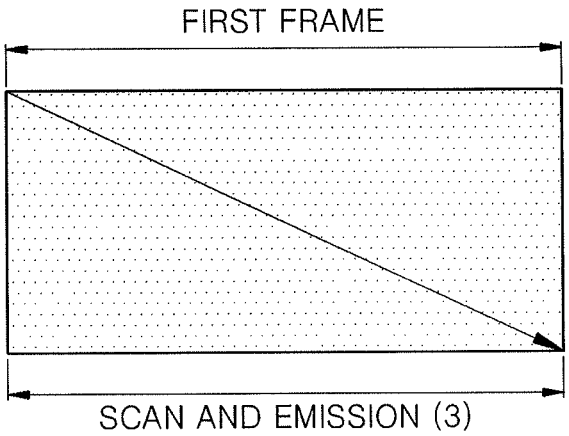

FIGS. 4 and 5 illustrate embodiments of operations for driving display apparatus 100. Referring to FIG. 4, display apparatus 100 is driven with a scan period 1 and an emission period 2 during one frame. In the scan period 1, scan signals are sequentially provided to a first scan line through a last scan line. A voltage corresponding to a data signal is charged in a capacitor of each emission pixel P. In emission period 2, emission devices E of all emission pixels P receive a current corresponding to the charged voltage and simultaneously emit light with a brightness that corresponds to the current.

If a defective pixel occurs among the emission pixels P, and thus a dummy pixel DP in the same column is used, scan signals and data signals are sequentially provided in scan period 1 to scan lines, including a scan line DSL connected to dummy pixel DP. In this case, the same data signal provided to the defective pixel is provided to the dummy pixel DP. In emission period 2, the emission devices E of all emission pixels P including the defective pixel receive a current corresponding to the charged voltage and simultaneously emit light with a brightness corresponding to the received current. The emission devices E of the defective pixel receive a current from the dummy pixel DP and emit light with a brightness corresponding to the received current.

The scan period 1 occurs prior to emission period 2. A voltage corresponding to a data signal of an $N^{th}$ frame is charged in each emission pixel P and the dummy pixel DP in scan period 1. Then, OLEDs of all emission pixels P emit light based on a current corresponding to the data signal of the $N^{th}$ frame in emission period 2.

When scanning and emission are repeated for a plurality of frames, at least a portion of scan period 1 and emission period 2 may overlap, e.g., at least a portion of emission period 2 of an $N-1^{th}$ frame may overlap scan period 1 of an $n^{th}$ frame.

Referring to FIG. 5, the display apparatus 100 according to the present embodiment is driven with a scan and emission period 3 during one frame. In the scan and emission period 3, scan signals are sequentially provided to a first scan line through a last scan line. Also, a voltage corresponding to a data signal of an $N^{th}$ frame is charged in a capacitor of each emission pixel P. At the same time, in the scan and emission period 3, emission devices E of all emission pixels P receive a current corresponding to a voltage charged in correspondence with a data signal of an $N-1^{th}$ frame. These emission devices E simultaneously emit light with a brightness corresponding to the received current. In the scan and emission period 3, an emission period may be the same as a scan period, or may start simultaneously with the scan period and may end prior to the scan period.

If a defective pixel occurs among the emission pixels P and thus a dummy pixel DP in the same column is used, in scan and emission period 3, scan signals are sequentially provided to scan lines including a scan line DSL connected to the dummy pixel DP. Also, the data signals of an $N^{th}$ frame are sequentially provided to data lines DL. In this case, the same data signal provided to the defective pixel is provided to the dummy pixel DP. At the same time, in scan and emission period 3, the emission devices E of all the emission pixels P including the defective pixel receive a current corresponding to a voltage charged in correspondence with a data signal of an $N-1^{th}$ frame. These emission devices E simultaneously emit light with a brightness corresponding to the received current. The emission devices E of the defective pixel receive a current from the dummy pixel DP and emit light with a brightness corresponding to the current.

Although only a scan period and an emission period are performed in one frame in FIGS. 4 and 5, an initialization period, compensation period for compensating a threshold voltage, and/or emission off period may also be performed in one frame.

Also, FIGS. 4 and 5 illustrate an example of a simultaneous emission method in which the emission devices E of the emission pixels P simultaneously emit light. In other embodiments, a sequential emission method may be performed in which the emission devices E of the emission pixels P sequentially emit light. The sequential emission method may be performed, for example, by controlling a timing of the signals provided to the emission pixels P.

Figure 6:
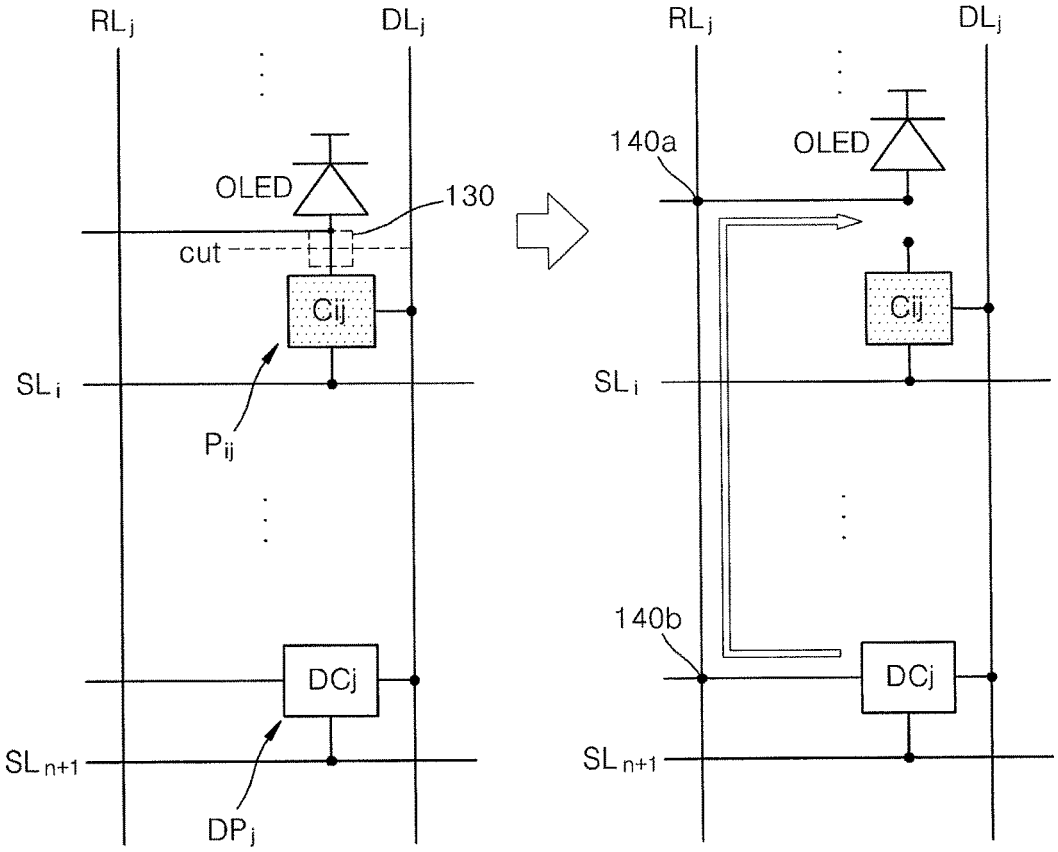
FIG. 6 illustrates an embodiment of a method for repairing a defective pixel.

FIG. 6 illustrates an embodiment of a method for repairing a defective pixel. Like the display panel 110 in FIG. 2, FIG. 6 corresponds to a case in which a dummy pixel DP is connected to a last scan line SLn+1, among a plurality of scan lines SL1 through SLn+1. For illustrative purposes only, a $j^{th}$ column is shown in FIG. 6 and also emission device E is shown as an OLED.

Referring to FIG. 6, if a pixel circuit Cij of an emission pixel Pij connected to an $i^{th}$ scan line and a $j^{th}$ data line is defective, an OLED connected to the pixel circuit Cij is disconnected from the pixel circuit Cij. This may be accomplished by electrically separating pixel circuit Cij from the OLED. For example, an anode of the OLED and the pixel circuit Cij of the defective emission pixel Pij may be cut in cutting unit 130. The separation by cutting may be performed, for example, by a laser beam.

Then, a first connecting unit 140*a* connects the OLED of the defective emission pixel Pij to a repair line RLj. A second connecting unit 140*b* connects a dummy pixel circuit DCj of the dummy pixel DPj to the repair line RLj. For example, an anode of the OLED of the defective emission pixel Pij may be connected to the repair line RLj. One electrode of a TFT in the dummy pixel circuit DCj of the dummy pixel DPj may be connected to repair line RLj. Accordingly, the OLED of the defective emission pixel Pij is disconnected from the pixel circuit Cij of the defective emission pixel Pij, and is electrically connected, via the repair line RLj, to the dummy pixel circuit DCj of the dummy pixel DPj.

Figure 7:
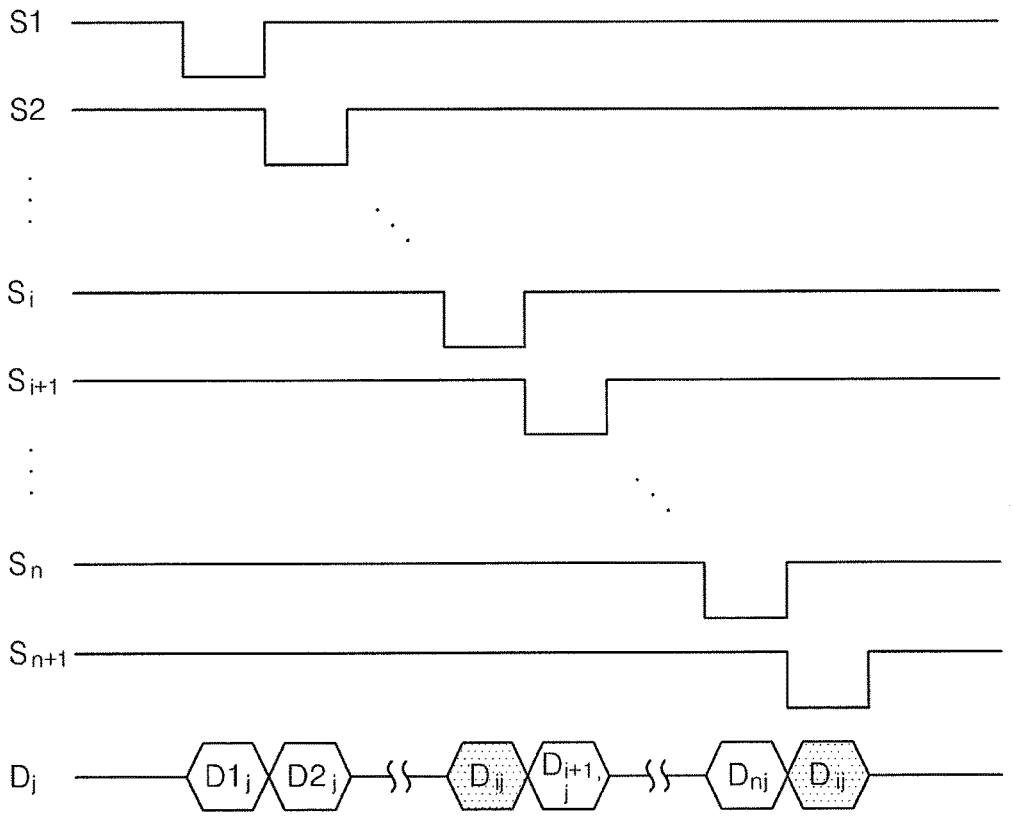
FIG. 7 illustrates scan and data signals for the method of FIG. 6.

FIG. 7 illustrates non-limiting examples waveforms of scan signals and data signals provided from a scan driving unit and data driving unit of a display panel having a pixel repaired by the method in FIG. 6. Referring to FIG. 7, in a scan period, the scan signals S1 through Sn+1 are sequentially provided to a first scan signal SL1 through a last scan signal SLn+1. The data signals D1*j* through Dnj are sequentially provided to a data line DLj in synchronization with scan signals S1 through Sn+1. In this case, the same data signal Dij as the data signal Dij provided to a defective emission pixel Pij is provided again to a dummy pixel DPj in synchronization with the scan signal Sn+1.

Accordingly, an OLED of the defective emission pixel Pij may receive a current corresponding to the data signal Dij via a dummy pixel circuit DCj of the dummy pixel DPj and a repair line RLj. Accordingly, in an emission period, all emission pixels including the defective emission pixel Pij may simultaneously emit light in a normal condition, and thus generation of a bright spot or a dark spot may be suppressed.

The waveforms in FIG. 7 are examples of the scan and the data signals driven in a simultaneous emission method embodiment. When the scan signals and the data signals are driven in a sequential emission method according to another embodiment, the driving method may be different from that of FIG. 7.

For example, when the organic light-emitting display apparatus is driven in the sequential emission method, a dummy scan line SLn+1 may provide a scan signal Si to the dummy pixel DPj which is the same as a scan signal Si provided to the defective emission pixel Pij. Also, a data line DLj, which provides the data signal to the dummy pixel DPj, may provide the data signal Dij in correspondence to a signal of level on of the scan signal Si provided from the dummy scan line SLn+1.

Alternatively, the dummy scan line SLn+1 may provide an additional scan signal Sn+1 to the dummy pixel DPj. Also, the data line DLj providing the data signal Dij to the dummy pixel DPj may provide the data signal Dij to the dummy pixel DPj in correspondence to a signal of level on of the scan signal Sn+1 provided from the dummy scan line SLn+1.

The scan signal provided to the dummy pixel DPj via the dummy scan line SLn+1 may vary in different embodiments. Although FIG. 7 illustrates a case in which the signal of level on of the scan signal is a low signal, the scan signal may be a high signal in other embodiments based, for example, on a design of the pixel circuit.

Figure 8:
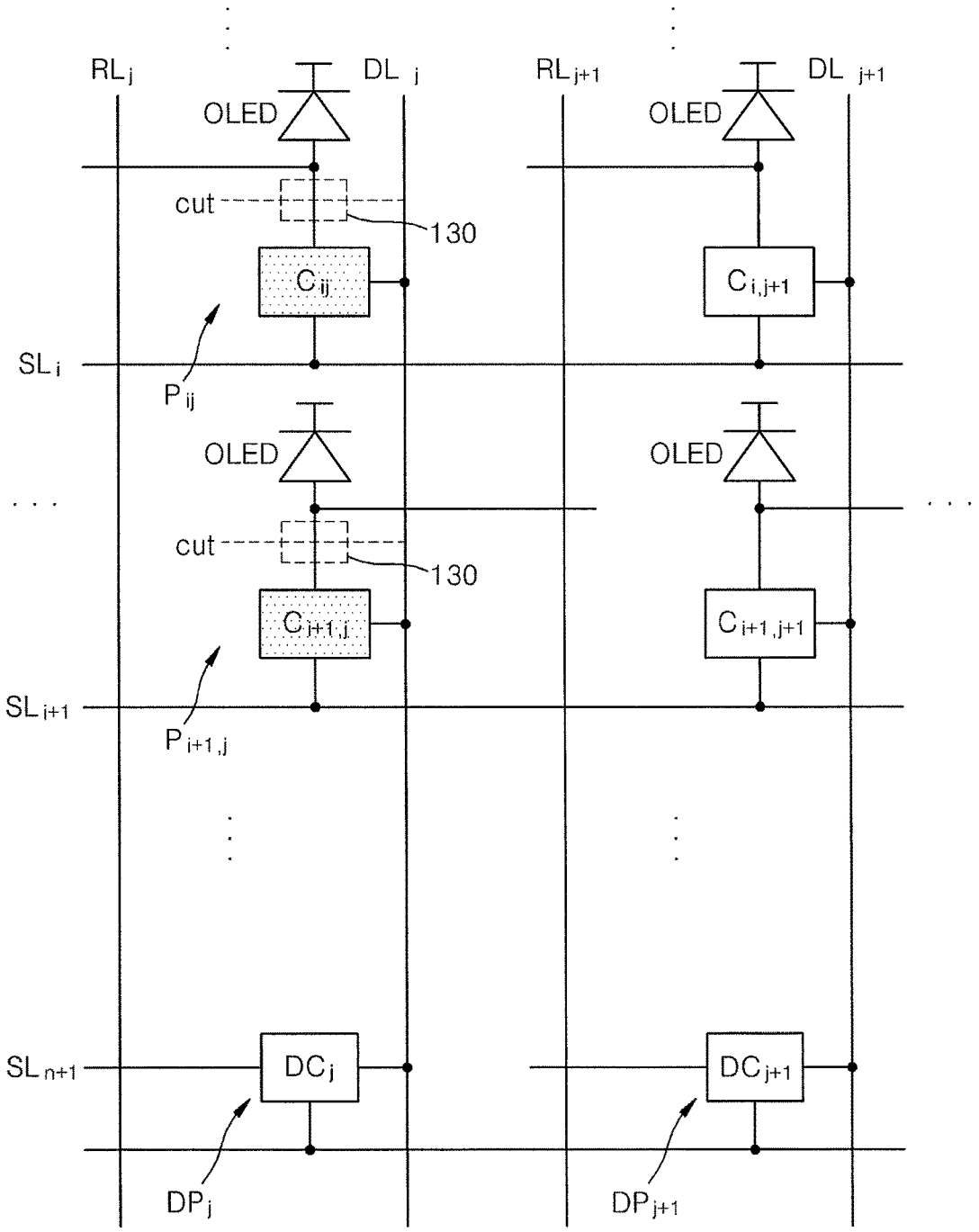
FIGS. 8 and 9 illustrate another embodiment of a method for repairing a defective pixel.
Figure 9:
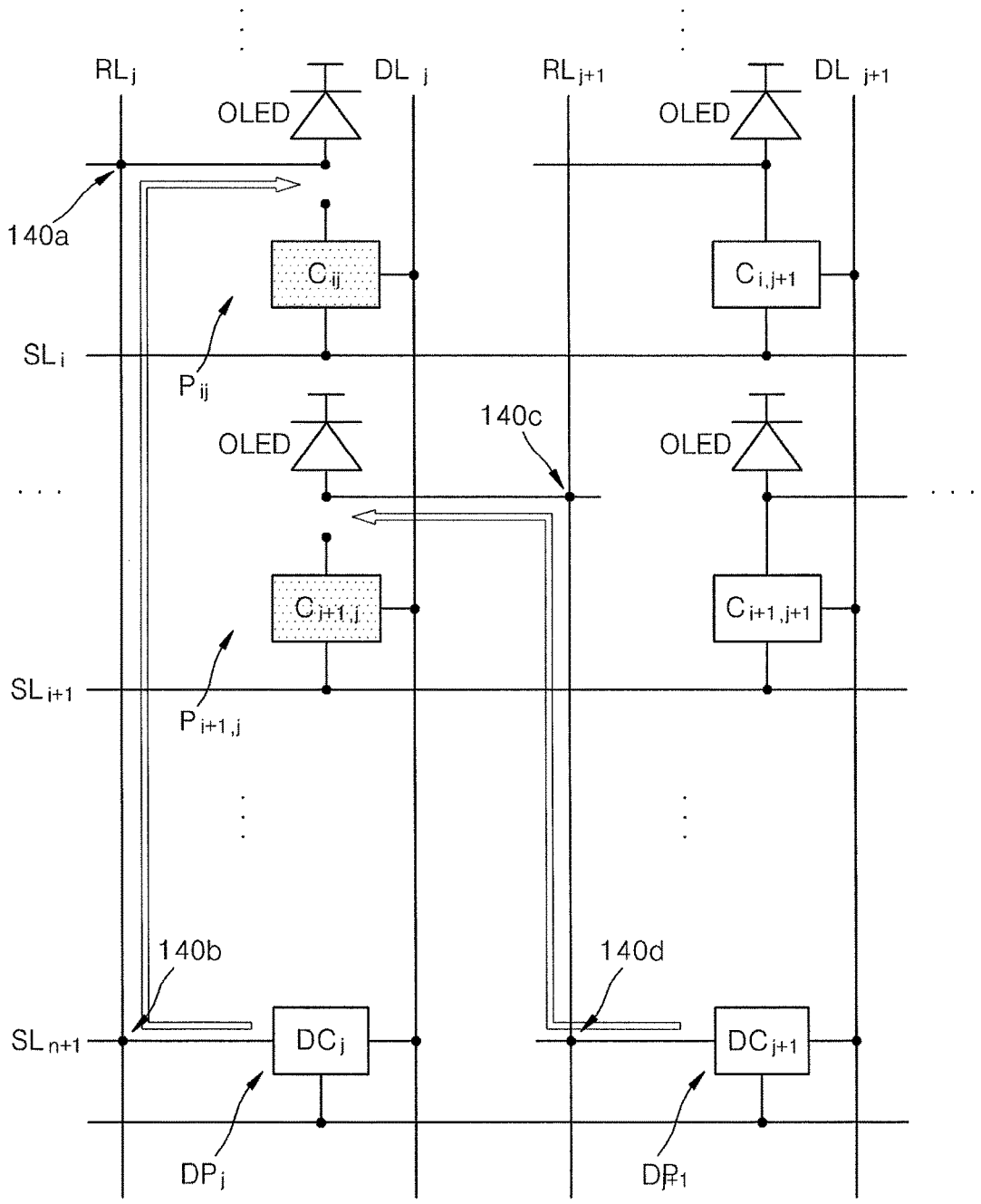

FIGS. 8 and 9 illustrate another embodiment of a method for repairing a defective pixel. For illustrative purposes only, FIGS. 8 and 9 illustrate a $j^{th}$ column and a $j+1^{th}$ column, and an OLED is illustrated as an emission device E.

Referring to FIG. 8, when a pixel circuit Cij of an emission pixel Pij connected to an $i^{th}$ scan line and a $j^{th}$ data line is defective, and a pixel circuit Ci+1, of an emission pixel Pi+1, j connected to an i+1$^{th}$ scan line and the j$^{th}$ data line is defective, the OLED is disconnected from the pixel circuit Cij and the OLED is disconnected from the pixel circuit Ci+1, j. That is, the pixel circuit Cij and the OLED are electrically separated from each other, and the OLED and the pixel circuit Ci+1, j are electrically separated from each other. For example, an anode of the OLED and the pixel circuit Cij of a first defective emission pixel Pij are cut by cutting unit 130, and an anode of the OLED and the pixel circuit Ci+1, j of a second defective emission pixel Pi+1, j may be cut by cutting unit 130. The cutting may be performed, for example, by a laser beam.

Referring to FIG. 9, the OLED of the first defective emission pixel Pij is connected to a repair line RLj in a first connecting unit 140*a*. A dummy pixel circuit DCj of a dummy pixel DPj is connected to the repair line RLj in a second connecting unit 140*b*. For example, the anode of the OLED of the first defective emission pixel Pij may be connected to the repair line RLj, and an electrode of a TFT in the dummy pixel circuit DCj of the dummy pixel DPj may be connected to the repair line RLj. Accordingly, the OLED of the first defective emission pixel Pij is disconnected from the pixel circuit Cij of the first defective emission pixel Pij, and is electrically connected to the dummy pixel circuit DCj of the dummy pixel DPj via the repair line RLj.

Also, referring to FIG. 9, the OLED of the second defective emission pixel Pi+1, j is connected to a repair line RLj+1 in a third connecting unit 140*c*. A dummy pixel circuit DCj+1 of a dummy pixel DPj+1 is connected to the repair line RLj+1 in a fourth connecting unit 140*d*. For example, the anode of the OLED of the second defective emission pixel Pi+1, j may be connected to the repair line RLj+1. An electrode of a TFT in the dummy pixel circuit DCj+1 of the dummy pixel DPj+1 may be connected to the repair line RLj+1. Accordingly, the OLED of the second defective emission pixel Pi+1, j is disconnected from the pixel circuit Ci+1, j of the second defective emission pixel Pi+1, j, and is electrically connected to the dummy pixel circuit DCj+1 of the dummy pixel DPj+1 via the repair line RLj+1.

According to the embodiment in FIGS. 8 and 9, when one dummy pixel DP is formed in one column and two defective emission pixels Pij occur in the one column, both of the two defective emission pixels Pij may be repaired by using the dummy pixel DP in another column. The defective emission pixel Pij may occur, for example, due to foreign materials or various problems that occur during manufacturing. Adjacent emission pixels may be defective because of various factors such as particles affecting the adjacent emission pixels. The adjacent defective pixels may be repaired in accordance with the embodiments described herein.

Figure 10:
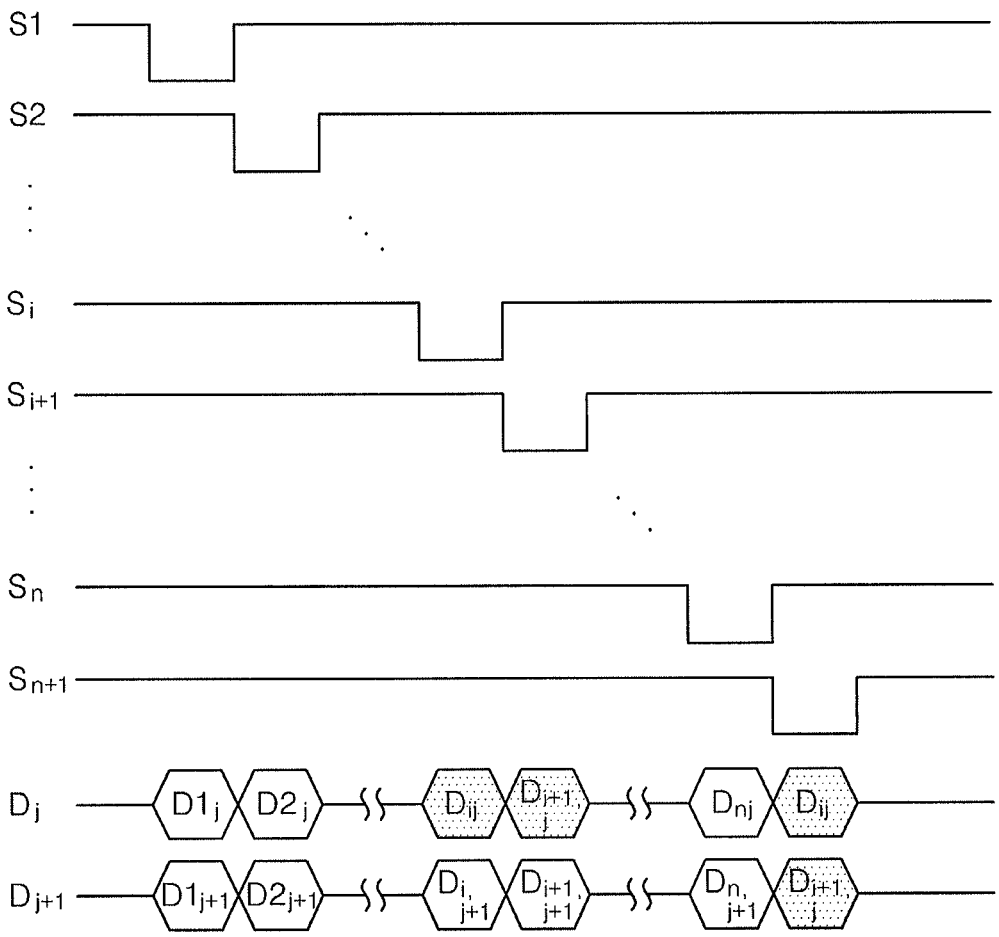
FIG. 10 illustrates scan and data signals for the method in FIGS. 8 and 9.

FIG. 10 illustrates non-limiting examples of waveforms of scan signals and data signals provided from a scan driving unit and a data driving unit of the display panel having the pixel repaired by the method in FIGS. 8 and 9.

Referring to FIG. 10, scan signals S1 through Sn+1 are sequentially provided to a first scan line SL1 through a last scan line SLn+1 in a scan period. Referring to FIG. 10, two adjacent defective pixels Pij and Pi+1j in a j$^{th}$ column are repaired using a dummy pixel DPj in the j$^{th}$ column and a dummy pixel DPj+1 in a j+1$^{th}$ column.

Data signals D1*j* through Dnj are sequentially provided to a data line DLj in synchronization with scan signals Si through Sn+1. The same data signal Dij provided to a first defective emission pixel Pij in the j$^{th}$ column is provided to the dummy pixel DPj in the j$^{th}$ column. Accordingly, an OLED of the first defective emission pixel Pij in the j$^{th}$ column may receive a current corresponding to the data signal Dij via a dummy pixel circuit DCj of the dummy pixel DPj and a repair line RLj in the j$^{th}$ column.

Data signals D1, j+1 through Dn, j+1 are sequentially provided to a data line DLj+1 in synchronization with scan signals S1 through Sn+1. The same data signal Di+1, j provided to a second defective emission pixel Pi+1, j in the j$^{th}$ column is provided to the dummy pixel DPj+1 in the j+1$^{th}$ column. Accordingly, an OLED of the second defective emission pixel Pi+1, j in the j$^{th}$ column may receive a current corresponding to the data signal Di+1, j via a dummy pixel circuit DCj+1 of the dummy pixel DPj+1 and a repair line RLj+1 in the j+1$^{th}$ column.

Accordingly, in an emission period, all emission pixels P including the first defective emission pixel Pij and second defective emission pixel Pi+1, j may simultaneously emit light in a normal condition. Thus, generation of a bright spot or a dark spot may be suppressed.

As described with respect to FIG. 7, the waveforms in FIG. 10 may be altered according to a sequential emission method used to drive the organic light-emitting display apparatus. For example, the timing of the scan signals and data signals provided to dummy pixels DPj and DPj+1 may be controlled by control unit 140 according to the sequential emission method.

Figure 11:
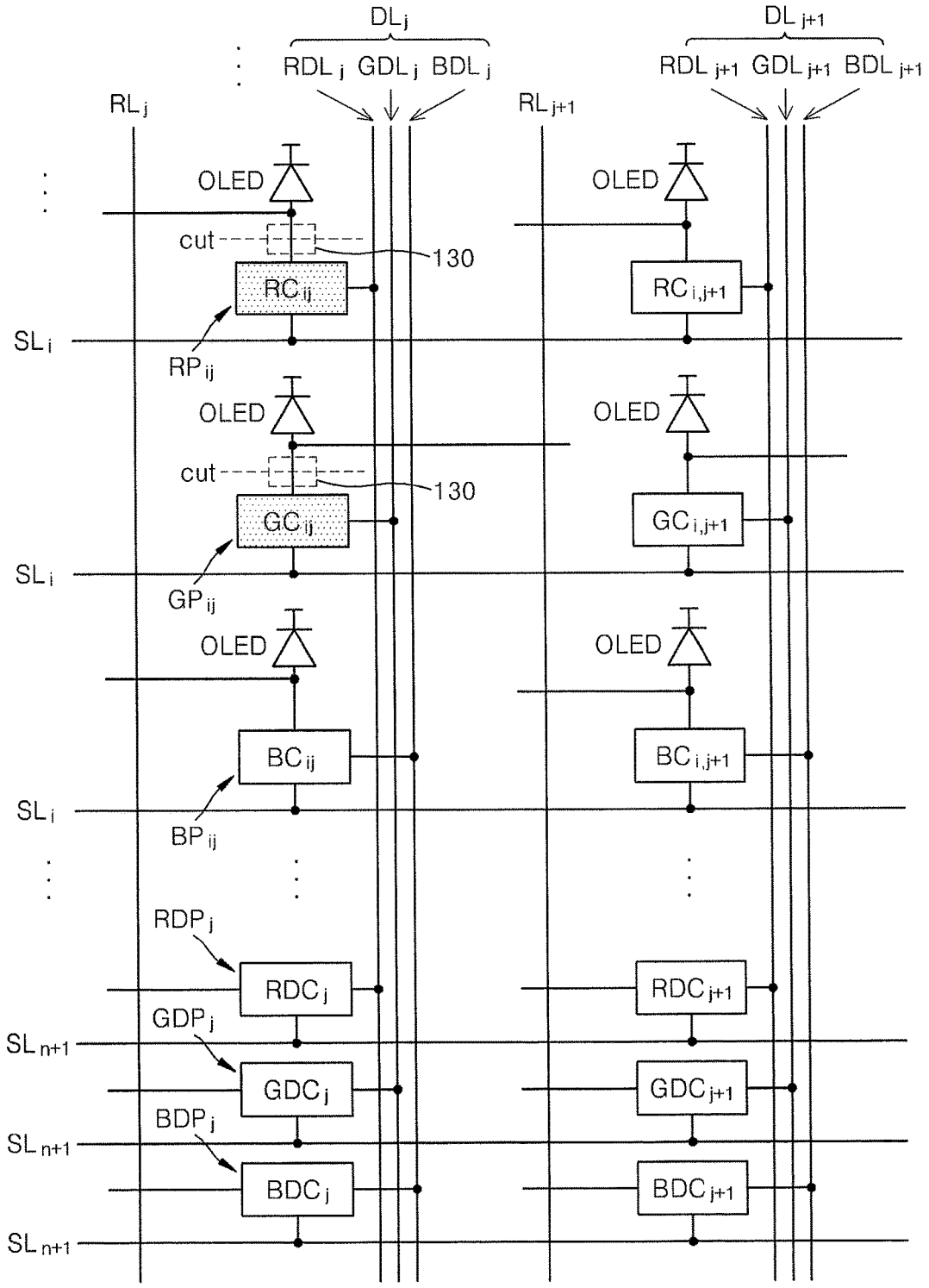
FIGS. 11 and 12 illustrate another embodiment of a method for repairing a defective pixel.
Figure 12:
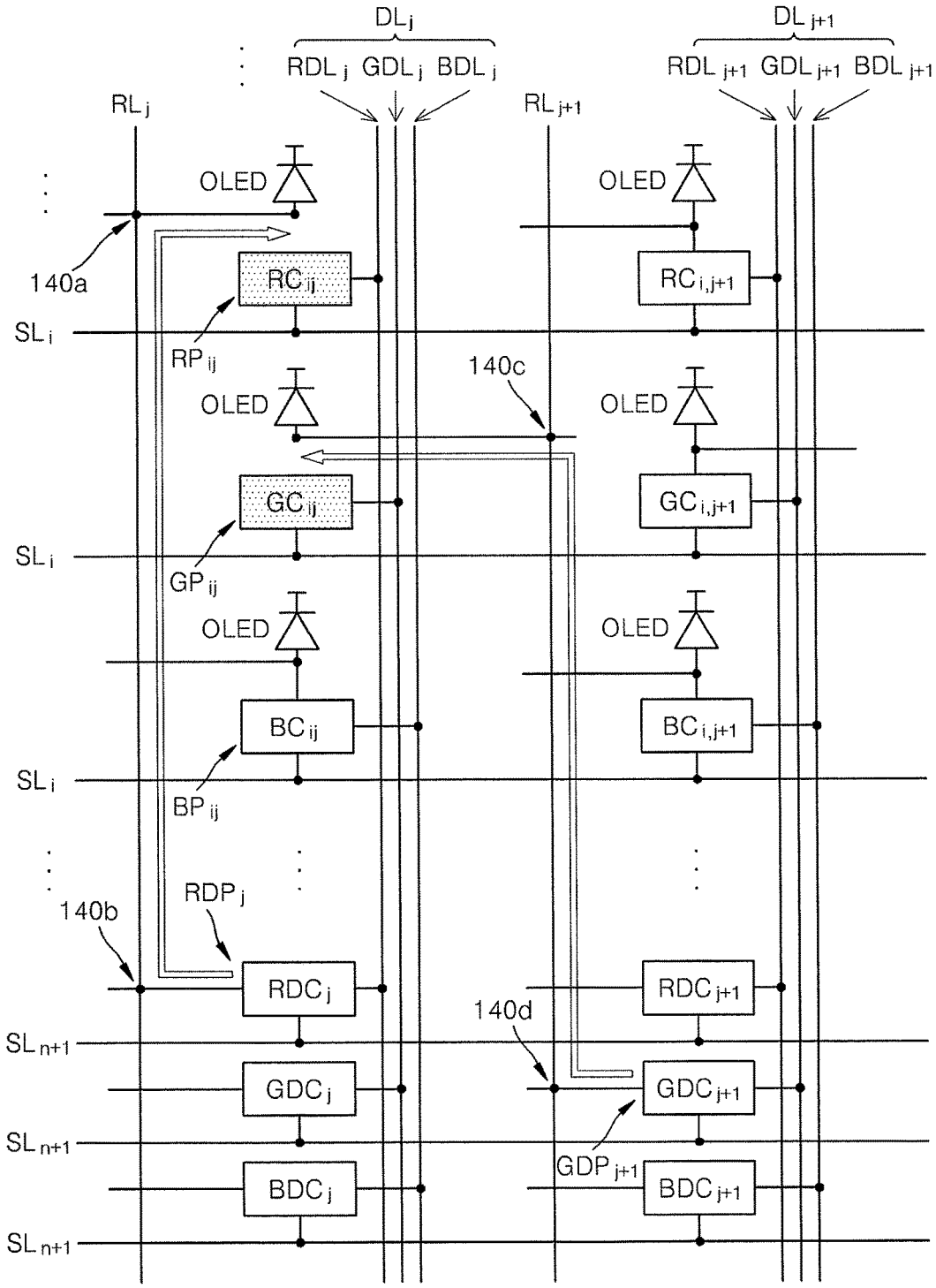

FIGS. 11 and 12 illustrate another embodiment of a method for repairing a defective pixel. For illustrative purposes only, FIGS. 11 and 12 illustrate a j$^{th}$ column and a j+1$^{th}$ column, and an OLED is illustrated as an emission device E.

According to the present embodiment, emission pixels P include a plurality of sub-emission pixels. For example, an emission pixel Pij connected to an i$^{th}$ scan line SLi and a j$^{th}$ data line DLj includes a plurality of sub-emission pixels RPij, GPij, and BPij. Each sub-emission pixel may emit one color. For example, each sub-emission pixel may emit one of a red, blue, green, or white color. In other embodiments, the sub-emission pixels may emit one or more other colors.

A scan line SLi connected to the sub-emission pixels RPij, GPij, and BPij in the emission pixel Pij provides the same scan signal Si to the sub-emission pixels RPij, GPij, and BPij. The sub-emission pixels RPij, GPij, and BPij in the emission pixel Pij receive data signals from separate data lines. For example, sub-emission pixel RPij, sub-emission pixel GPij, and sub-emission pixel BPij receive data signals from data line RDLj, data line GDLj, and data line BDLj, respectively. The data lines RDLj, GDLj, and BDLj may provide different data signals.

A dummy pixel DPj may include a plurality of sub-dummy pixels RDPj, GDPj, and BDPj. The sub-dummy pixels RDPj, GDPj, and BDPj may be connected to data lines RDLj, GDLj, and BDPj, respectively. A scan line SLn+1 connected to the each of the sub-dummy pixel RDPj, GDPj, and BDPj may provide the same scan signal Sn+1 to each of the sub-dummy pixel RDPj, GDPj, and BDPj.

In other embodiments, different dummy scan lines may be connected to the sub-dummy pixels RDPj, GDPj, and BDPj, and the different dummy scan lines may provide different scan signals to the sub-dummy pixels RDPj, GDPj, and BDPj.

FIGS. 11 and 12 illustrate a case in which the same scan line SLn+1 is connected to sub-dummy pixels RDPj, GDPj, and BDPj. According to the present embodiment, scan line SLn+1 may be connected to sub-dummy pixels RDPj, GDPj, and BDPj, and may provide the same scan signal Sn+1 to each of the sub-dummy pixels RDPj, GDPj, and BDPj. In other embodiments, different scan lines SLn+1, SLn+2, or SLn+3 may be connected to the sub-dummy pixels RDPj, GDPj, and BDPj and may provide different scan signal SLn+1, SLn+2, or SLn+3 to the sub-dummy pixels RDPj, GDPj, and BDPj. The scan signal provided to the plurality of sub-dummy pixels RDPj, GDPj, and BDPj may be controlled by the scan driving unit 120 of FIG. 1.

Referring to FIG. 11, when pixel circuits RCij and GCij of two adjacent sub-emission pixels RPij and GPij connected to an $i^{th}$ scan line and a $j^{th}$ data line are defective, the pixel circuit RCij and OLED are disconnected and the pixel circuit GCij and the OLED are disconnected.

That is, the pixel circuit RCij and the OLED are electrically disconnected, and the pixel circuit GCij and the OLED are electrically disconnected. For example, an anode of the OLED and the pixel circuit RCij of the first defective emission pixel RPij may be cut by cutting unit 130. An anode of the OLED and pixel circuit GCij of the second defective emission pixel GPij may be cut by cutting unit 130. The cut may be performed, for example, by a laser beam.

Referring to FIG. 12, the OLED of the first defective emission pixel RPij is connected to a repair line RLj in a first connecting unit 140*a*. A dummy pixel circuit RDCj of the sub-dummy pixel RDPj is connected to the repair line RLj in a second connecting unit 140*b*. For example, the anode of the OLED of the first defective emission pixel RPij may be connected to the repair line RLj. An electrode of a TFT in the dummy pixel circuit RDCj of the sub-dummy pixel RDPj may be connected to repair line RLj. Accordingly, the OLED of first defective emission pixel RPij is disconnected from pixel circuit RCij of the first defective emission pixel RPij, and is electrically connected to dummy pixel circuit RDCj of sub-dummy pixel RDPj via repair line RLj.

Referring to FIG. 12, the OLED of the second defective emission pixel GPij is connected to a repair line RLj+1 in a third connecting unit 140*c*. A dummy pixel circuit GDCj+1 of a sub-dummy pixel GDPj is connected to the repair line RLj+1 in a fourth connecting unit 140*d*. For example, an anode of the OLED of the second defective emission pixel GPij may be connected to the repair line RLj+1. An electrode of a TFT in the dummy pixel circuit GDCj+1 of the sub-dummy pixel GDPj+1 may be connected to repair line RLj+1. Accordingly, the OLED of the second defective emission pixel GPij is disconnected from the pixel circuit GCij of the second defective emission pixel GPij, and is electrically connected to dummy pixel circuit GDCj+1 of dummy pixel GDPj+1 via repair line RLj+1.

According to the embodiment in FIGS. 11 and 12, when two defective emission pixels RPij and GPij occur in one column, even if only one repair line RLj is included in the one column, both of the two defective emission pixels RPij and GPij may be repaired by using repair line RLj+1 in another column.

Also, according to the embodiment illustrated in FIGS. 11 and 12, sub-dummy pixels RDPj and GDPj+1 connected to scan line SLn+1 may be used for the repair. In addition, sub-dummy pixels RDPj and GDPj+1 corresponding to sub-emission pixels RPij and GPij in which the defects occur may be used for the repair. Each sub-emission pixel RPij, GPij, and BPij in the emission pixel Pij may be designed to have a different type of transistor in a circuit, a different design, and/or a different device value and size. Thus, when repairing the sub-emission pixels, a high quality repair may be possible using sub-dummy pixels for the sub-emission pixels.

The sub-dummy pixels to be used for repair may be selected by various methods. For example, a dummy pixel circuit RDCj+1 of a dummy pixel RDPj+1 may be used to repair the second defective emission pixel GPij. In this case, the scan signals provided to the sub-dummy pixels may be diversely controlled according to the selection of the sub-dummy pixels.

Figure 13:
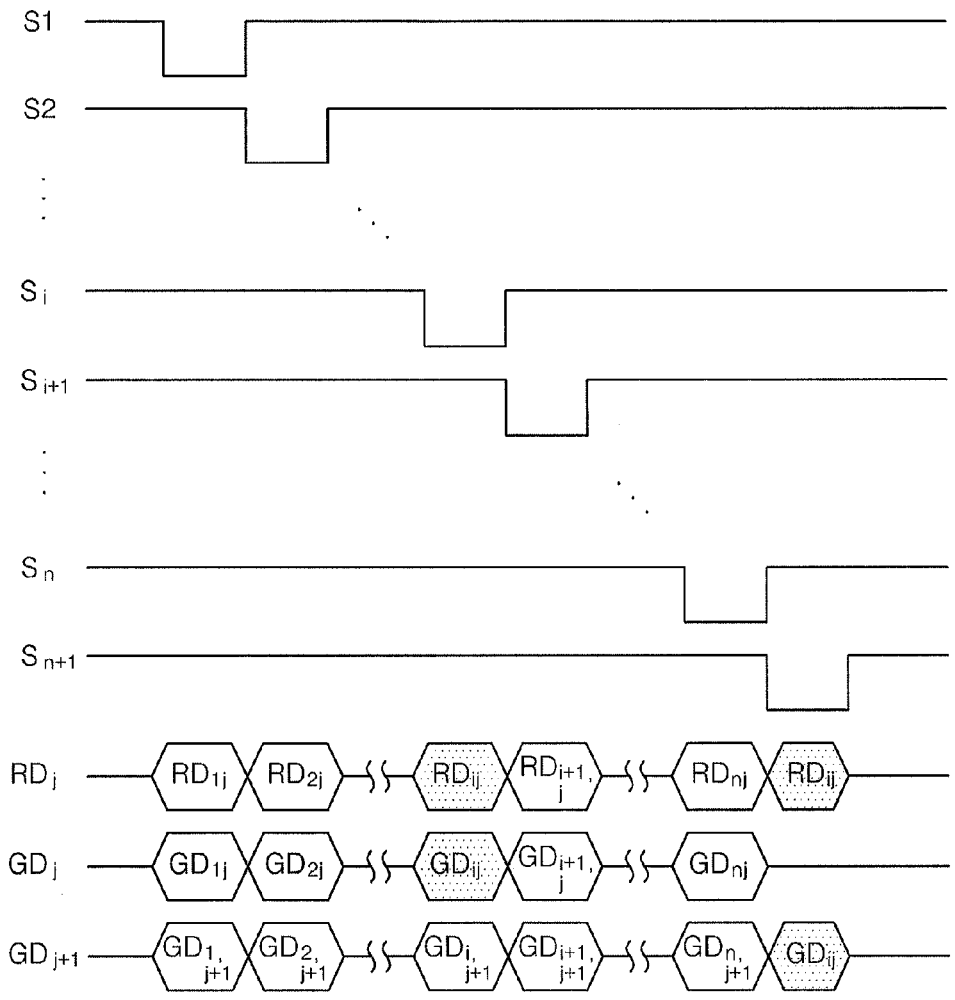
FIG. 13 illustrates scan and data signals for the method in FIGS. 11 and 12.

FIG. 13 illustrates examples of waveforms of scan signals and data signals provided from a scan driving unit of a display panel in which the pixels are repaired by the method in FIGS. 11 and 12. Referring to FIG. 13, adjacent defective pixels RPij and GPij in a $j^{th}$ column are repaired using a dummy pixel RDPj in the $j^{th}$ column and a dummy pixel GDPj+1 in a $j+1^{th}$ column. Data signals provided to defective pixels RPij and GPij are provided as data signals of dummy pixels RDPj and GDPj+1.

Also, referring to FIG. 13, in a scan period, scan signals S1 through Sn+1 are sequentially provided to a first scan line SL1 through a last scan line SLn+1. In the waveforms of FIG. 13, a case in which sub-dummy pixels RDPj and GDPj+1 receive scan signals S1 through Sn+1 from scan line SLn+1 is illustrated. In other embodiments, this may not be the case.

Data signals RD1*j* through RDnj are sequentially provided to a data line RDLj in synchronization with scan signals S1 through Sn. Also, the same data signal RDij provided to a first defective emission pixel RPij in the $j^{th}$ column is provided to dummy pixel RDPj in the $j^{th}$ column in synchronization with scan signal Sn+1. Accordingly, an OLED of the first defective emission pixel RPij in the $j^{th}$ column may receive a current corresponding to the data signal RDij from a pixel circuit RDCj of the dummy pixel RDPj via a repair line RLj of the $j^{th}$ column. More specifically, the OLED of the first defective emission pixel RPij may receive the current corresponding to the data signal RDij via the repair line RLj, at a timing when scan signal Sn+1 is turned to a on level.

Data signals GD1*j* through GDnj are sequentially provided to a data line GDLj in synchronization with scan signals S1 through Sn. Also, the same data signal GDij provided to a second defective emission pixel GPij in a $j+1^{th}$ column is provided to the dummy pixel GDPj+1 in the $j+1^{th}$ column in synchronization with scan signal Sn+1. Accordingly, an OLED of the second defective emission pixel GPij in the $j^{th}$ column may receive a current corresponding to data signal GDij from a pixel circuit GDCj+1 of a dummy pixel GDPj+1 via a repair line RLj+1 of the $J+1^{th}$ column. More specifically, the OLED of the second defective emission pixel GPij may receive the current corresponding to the data signal GDij via the repair line RLJ+1, at a timing when the scan signal Sn+1 is turned to an on level.

Accordingly, all emission pixels P including the first defective emission pixel RPij and the second defective emission pixel GPij that are adjacent in the same column may simultaneously emit light normally in an emission period. As a result, bright spot or a dark spot may be suppressed.

As described with respect to FIG. 7, the waveforms in FIG. 13 may be altered according to the sequential emission method used to drive the organic light-emitting display apparatus. For example, the timing of scan signals and data signals provided to dummy pixels RDPj and GDPj+1 may be controlled by control unit 140 according to the sequential emission method.

Figure 14:
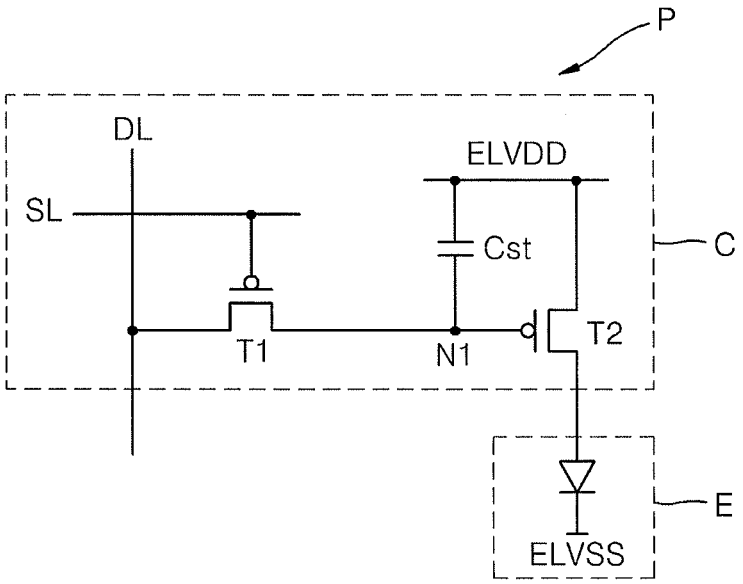
FIG. 14 illustrates an embodiment of an emission pixel.

FIG. 14 illustrates an embodiment of an emission pixel P which includes an emission pixel circuit C for providing a current to an emission device E. The emission device E may be an OLED including an emission layer between a first electrode and a second electrode. The first and second electrodes may be an anode and cathode, respectively. The emission pixel circuit C may include two transistors T1 and T2 and one capacitor C.

The first transistor T1 has a gate electrode connected to a scan line, a first electrode connected to a data line, and a second electrode connected to a first node N1.

The second transistor T2 has a gate electrode connected to the first node N1, a first electrode that receives a first power voltage ELVDD, and a second electrode connected to a pixel electrode of emission device E.

The capacitor Cst has a first electrode connected to first node N1 and a second electrode that receives first power voltage ELVDD.

The first transistor T1 transmits a data signal D from a data line DL to the first electrode of the capacitor Cst, when a scan signal S is provided from a scan line SL. Accordingly, a voltage corresponding to data signal D is charged in capacitor Cst. A driving current corresponding to the voltage charged in the capacitor Cst is transmitted to the emission device E via the second transistor T2, to cause emission device E to emit light.

FIG. 14 illustrates a 2Tr-1Cap structure, in which two transistors and one capacitor are provided in one pixel. In other embodiments, at least two TFTs and at least one capacitor may be provided in one pixel. Additionally, or alternatively, additional wirings may be included or previous wirings may be omitted, thereby making various structures possible.

Figure 15:
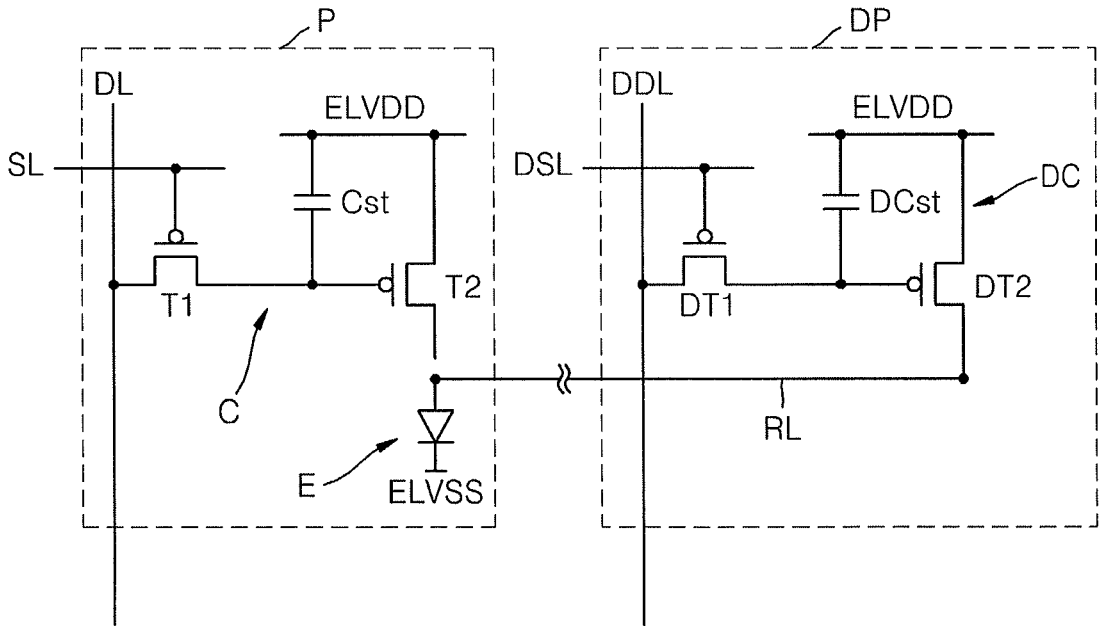
FIG. 15 illustrates an embodiment of a method for repairing an emission pixel using a dummy pixel.

FIG. 15 illustrates another embodiment of a method for repairing an emission pixel using a dummy pixel. Referring to FIG. 15, emission pixel P includes emission pixel circuit C for providing a current to emission device E. In one embodiment, emission pixel P of FIG. 15 may be the same as emission pixel P of FIG. 14.

The dummy pixel DP may be arranged in the same column or row as emission pixel P. The dummy pixel DP may include only a dummy pixel circuit DC. In other embodiments, dummy pixel DP may include emission device E. The dummy pixel circuit DC may be the same as or different from emission pixel circuit C.

The dummy pixel circuit DC may include a first dummy transistor DT1 connected to a dummy scan line DSL and a dummy data line DDL, a second dummy transistor DT2 connected between the first power voltage ELVDD and the first dummy transistor DT1, and a dummy capacitor DCst connected between the first power voltage ELVDD and the first dummy transistor DT1. FIG. 15 illustrates one example of many possible dummy pixel circuit DC that may be included. For example, dummy pixel circuit DC may have various structures, including one in which at least one TFT and at least one capacitor are included or on in which the capacitor is excluded.

The dummy scan line DSL may be the same or different scan line as/from a scan line SL arranged for emission pixel circuit C. The dummy data line DDL may be the same or different data line as/from a data line DL arranged for emission pixel circuit C.

When emission pixel circuit C is defective, emission pixel circuit C and emission device E are separated. Then, emission device E is connected to the dummy pixel circuit DC in the same column or row via a repair line RL. As a result, emission device E of emission pixel P may receive a driving current from dummy pixel circuit DC and normally emit light. The separation and connection between the devices may be performed by a cutting or welding operation using a laser or another technique.

The embodiments of the present invention are not limited to a specific pixel structure described above, but may be applied to various pixels thereby making an emission without a loss in brightness possible by repairing a bright spot or a dark spot of a pixel which is defective due to a defect of the pixel circuit.

Figure 16:
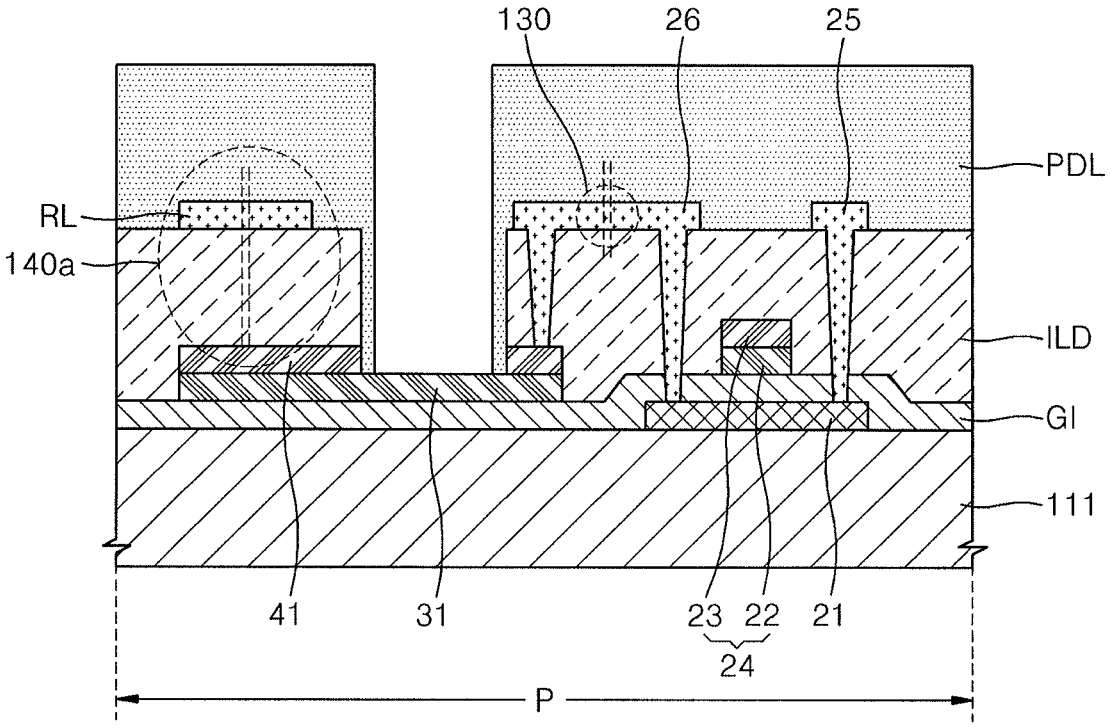
FIG. 16 illustrates an embodiment for repairing of the emission pixel.
Figure 17:
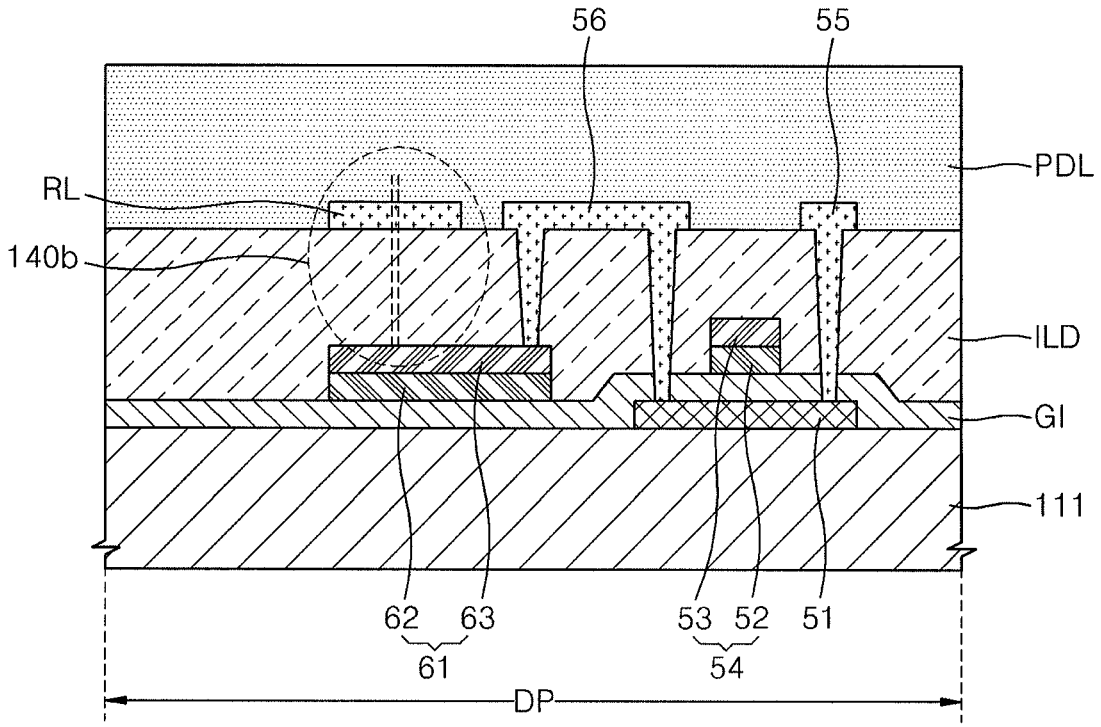
FIG. 17 illustrates an embodiment which includes connection of a dummy pixel.

FIG. 16 illustrates a cross-sectional view for describing repair of an emission pixel in an organic light-emitting display apparatus according to another embodiment. FIG. 17 is a cross-sectional view for describing a connection of a dummy pixel in an organic light-emitting display apparatus according to another embodiment. For illustrative purposes only, FIGS. 16 and 17 illustrate only one TFT connected to a repair line RL among pixel circuits of the emission pixel and the dummy pixel. The embodiment in FIGS. 16 and 17 corresponds to a case in which repair is performed after a vision test of the display panel.

Referring to FIGS. 16 and 17, an active layer 21 of the TFT of emission pixel P and an active layer 51 of the TFT of dummy pixel DP are formed on an upper portion of a substrate 111. To prevent diffusion of impurity ions and penetration of water or contamination from foreign matter on an upper surface of substrate 111, and to planarize the surface, a supplementary layer such as a barrier layer, a blocking layer, and/or a buffer layer may be included.

The active layers 21 and 51 may include a semiconductor, and may include ion impurities by doping. Also, active layers 21 and 51 may be formed of an oxide semiconductor. The active layers 21 and 51 include a source region, a drain region, and a channel region. A gate insulating layer GI is formed on an upper portion of the substrate 111 on which the active layers 21 and 51 are formed.

A gate electrode 24 of emission pixel P and a gate electrode 54 of dummy pixel DP are formed on an upper portion of the gate insulating layer GI. The gate electrodes 24 and 54 are formed to correspond to the channel region of active layers 21 and 51. The gate electrodes 24 and 54 are formed by sequentially stacking a first conductive layer and a second conductive layer on the gate insulating layer GI, and etching the first and second conductive layers. The gate electrode 54 may include a first gate electrode 22 and 52 formed as a part of the first conductive layer and a second gate electrode 23 and 53 formed as a part of the second conductive layer.

In addition, a pixel electrode 31 and a first connecting member 41 of the emission pixel P, and a second connecting member 61 of the dummy pixel DP, are formed on the upper portion of the gate insulating layer GI. The pixel electrode 31 is formed as a part of the first conductive layer, which is exposed by removing a part of the second conductive layer. The first connecting member 41 may be an extension unit extending from pixel electrode 31 and parts of the first conductive layer and second conductive layer.

The second connecting member 61 may include a first layer 62 formed as a part of the first conductive layer and a second layer 63 formed as a part of the second conductive layer. An interlayer insulating layer ILD is formed on the upper portion of substrate 111 on which the gate electrodes 24 and 54 and the first and second connecting members 41 and 61 are formed.

A source electrode 25 and 26 and a drain electrode 55 and 56, contacting the source region and the drain region of active layers 21 and 52 through a contact hole, are formed on the interlayer insulating layer ILD. Also, repair line RL is formed on the interlayer insulating layer ILD such that repair line RL at least partially overlaps the first and second connecting members 41 and 61. A pixel defining layer PDL is formed on the upper portion of the substrate 111 on which the source electrode 25 and 26, the drain electrode 55 and 56, and the repair line RL are formed.

The TFT and pixel electrode 31 of the emission pixel P are electrically separated in emission pixel P detected as a defective pixel after the vision test. The electrical separation may be performed by cutting, using cutting unit 130, the connection of one of the source electrode 25 or drain electrode 26 to the pixel electrode 31. Accordingly, the pixel circuit and pixel electrode 31 of the defective emission pixel are electrically separated. A laser beam may be irradiated to perform the cutting of the cutting unit 130.

The first connecting unit 140*a* in emission pixel P may be shorted by destroying the insulating layer between the repair line RL and first connecting member 41, which may be interlayer insulating layer ILD. Accordingly, the insulating layer between the repair line RL and first connecting member 41 is destroyed, so that repair line RL and first connecting member 41 are electrically connected. Also, the second connecting unit 140*b* of the dummy pixel DP is shorted.

Accordingly, the insulating layer between repair line RL and second connecting member 61 is destroyed, so that repair line RL and second connecting member 61 are electrically connected. To short the first and second connecting units 140 and 140*b*, laser welding may be performed, for example, by irradiating a laser beam. When cutting and shorting are performed by irradiating the laser beam in FIGS. 16 and 17, the laser beam may be irradiated from the upper portion or the bottom portion of substrate 111.

Before the vision test, an organic layer including an emission layer and a counter electrode may be sequentially formed on pixel electrode 31. When the organic layer emits light of a red, green, or blue color, the emission layer may be patterned as a red, green, or blue emission layer. When the organic layer emits a white color, the emission layer may have a multi-layered structure in which the red emission layer, green emission layer, and blue emission layer are stacked on one another. Alternatively, the emission layer may have a single-layered structure including a red emission material, a green emission material, and a blue emission material. In this case, the emission layer may emit white light.

The counter electrode may be formed as a common electrode by being deposited on an entire surface of substrate 111. According to the present embodiment, the pixel electrode 31 is used as an anode and the counter electrode is used as a cathode. However, the polarities of pixel electrode 31 and counter electrode may be switched.

According to one or more of the aforementioned embodiments, a defect of a pixel circuit may be easily repaired using a repair line, thereby improving the manufacturing yield rate of the display apparatus. Also, according to the one or more of the aforementioned embodiments, a defect of an emission pixel P is repaired using a dummy pixel DP, so that the defective emission pixel P may emit light at a normal timing.

Additionally, according to one or more of the aforementioned embodiments, even if only one repair line is formed in each column, a plurality of defective pixels adjacent to one another in one column may be repaired. The more repair lines that are formed, the larger the area that the wirings occupy in the display panel 110. Thus, aperture ratio or stability may have problems. However, according to one or more of the aforementioned embodiments, since the defective pixels are repaired using a minimum number of the repair lines, aperture ratio and stability may be obtained while effectively repairing the defective pixels.

Also, a defective emission pixel may occur due to foreign materials or various problems in a manufacturing process. For example, since a particle affects a number of adjacent emission pixels, it is easy for the adjacent emission pixels to be defective altogether. According to one or more of the aforementioned embodiments, the defective emission pixels adjacent in the same column or row may be repaired.

As described above, according to the one or more of the above embodiments, the display apparatus may repair the defective pixel using a dummy pixel, thereby normally driving the pixel without generating a bright spot or dark spot. Also, the display apparatus repairs the plurality of defective pixels using a plurality of dummy pixels, even when a plurality of pixels that are adjacent to one other are defective in a same column, thereby allowing the pixels to be driven normally.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display apparatus, comprising:

a plurality of emission pixels in columns and rows in an active region;

a plurality of dummy pixels in a dummy region; and a plurality of repair lines in the columns, wherein emission pixels connectable to a corresponding repair line and emission pixels connectable to a repair line adjacent to the corresponding repair line are arranged in a same column, and wherein each of the repair lines is connectable to one of the emission pixels in a corresponding column and one of the dummy pixels in the corresponding column, or one of the emission pixels in a column adjacent to the corresponding column and the one of the dummy pixels in the corresponding column.

2. The display apparatus as claimed in claim 1, wherein the repair lines include:

a first repair line corresponding to a first column, and a second repair line corresponding to a second column adjacent to the first column, wherein the emission pixels include:

a first emission pixel in the first column, and a second emission pixel adjacent to the first emission pixel in the first column, wherein:

the first emission pixels is connectable to the first repair line, and the second emission pixel is connectable to the second repair line.

3. The display apparatus as claimed in claim 2, wherein the repair lines further comprises a third repair line in a third column adjacent to the second column, the third repair line being connectable to one of the emission pixels in the second column and one of the dummy pixels in the third column, and wherein the emission pixels are not arranged in the third column.

4. The display apparatus as claimed in claim 1, wherein:
a number of columns of the dummy pixels is at least one more than a number of columns of the emission pixels, and
the number of columns of the dummy pixels is a number of the repair lines.

5. The display apparatus as claimed in claim 1, wherein each of the emission pixels is connected to a corresponding scan line and a corresponding data line, and wherein each of the dummy pixels is connected to a corresponding dummy scan line and a corresponding data line.

6. The display apparatus as claimed in claim 5, wherein at least one of the repair lines is connected to the one of the emission pixels in the corresponding column and the one of the dummy pixels in the corresponding column, or the one of the emission pixels in the column adjacent to the corresponding column and the one of the dummy pixels in the corresponding column.

7. The display apparatus as claimed in claim 6, wherein:
when a scan signal is provided to the one of the dummy pixels connected to the at least one of the repair lines, a data signal provided to the one of the dummy pixels connected to the at least one of the repair lines is provided to the one of the emission pixels connected to the at least one of the repair lines via the at least one of the repair lines.

8. The display apparatus as claimed in claim 6, wherein:
each of the emission pixels includes an emission device and an emission pixel circuit connected to the emission device,
each of the dummy pixels includes a dummy pixel circuit, and
an emission device of the one of the emission pixels connected to the at least one of the repair lines is connected to a dummy pixel circuit of the one of the dummy pixels connected to the at least one of the repair lines.

9. The display apparatus as claimed in claim 8, wherein the emission pixel circuit includes:
a first transistor to transmit a data signal in response to a scan signal;
a capacitor to store a voltage corresponding to the transmitted data signal; and
a second transistor to transmit a driving current corresponding to the voltage stored in the capacitor to the emission device.

10. The display apparatus as claimed in claim 6, further comprising:
a first conductive unit contacting an anode of an emission device of the one of the emission pixels connected to the one of the dummy pixels and the at least one of the repair lines, and
a second conductive unit contacting a dummy pixel circuit of the one of the dummy pixels and the at least one of the repair lines.

11. The display apparatus of claim 8, wherein the dummy pixel circuit is same as the emission pixel circuit.

12. The display apparatus as claimed in claim 8, wherein:
the emission device and an emission pixel circuit of the one of the emission pixels connected to the at least one of the repair lines are disconnected.

13. The display apparatus as claimed in claim 5, wherein at least one outermost dummy pixel in an outermost portion among the plurality of dummy pixels is connected to a dummy data line and receives a data signal from the dummy data line.

14. The display apparatus as claimed in claim 1, wherein:
each of the emission pixels includes at least one sub-emission pixel,
each of the dummy pixels includes at least one sub-dummy pixel, and
the at least one of the repair lines connects one of the at least one sub-emission pixel and one of the at least one sub-dummy pixel.

15. The display apparatus as claimed in claim 14, wherein each of the dummy pixels includes a same number of the at least one sub-dummy pixel as the at least one sub-emission pixel.

16. The display apparatus as claimed in claim 1, wherein the dummy region is arranged in at least one of an upper side or a bottom side of the active region.

17. The display apparatus as claimed in claim 1, further comprising:
a first conductive unit contacting an anode of an emission device of the one of the emission pixels and overlapping the at least one of the repair lines, and
a second conductive unit contacting a dummy pixel circuit of the one of the dummy pixels and overlapping the at least one of the repair lines.

18. The display apparatus as claimed in claim 1, wherein the emission pixels connectable to the corresponding repair line and the emission pixels connectable to the repair line adjacent to the corresponding repair line are alternately aligned in the same column.

19. A method for repairing an organic light-emitting display apparatus, the organic light-emitting display apparatus comprising a plurality of emission pixels in columns and rows in an active region, a plurality of dummy pixels in a dummy region, and a plurality of repair lines in the columns, the method comprising:
disconnecting emission devices and emission pixel circuits of a first defective pixel and a second defective pixel of the emission pixels in a first column;
connecting a first repair line in the first column to the emission device of the first defective pixel in the first column;
connecting a second repair line in a second column adjacent to the first column, to the emission device of the second defective pixel in the first column; and
connecting a dummy pixel circuit of a first dummy pixel of the dummy pixels in the first column to the first repair line,
connecting a dummy pixel circuit of a second dummy pixel of the dummy pixels in the second column to the second repair line.

20. A display device, comprising:
a first repair line in a first column;
a second repair line in a second column;
a first dummy pixel circuit in the first column;
a second dummy pixel circuit in the second column;
a sequence of first emission pixels in the first column; and
a sequence of second emission pixels in the second column, wherein:
the first dummy pixel circuit is connected to a first data line, which is connected to the sequence of first emission pixels,
the second dummy pixel circuit is connected to a second data line, which is connected to the sequence of second emission pixels, and
the first repair line connects the first dummy pixel circuit in the first column to a first one of the sequence of first emission pixels in the first column and the second repair line connects the second dummy pixel circuit in the second column to a second one of the sequence of first emission pixels in the first column.

21. The display device as claimed in claim 20, further comprises a third repair line and a third dummy pixel circuit in a third column, wherein the third repair line connects the third dummy pixel circuit to an emission pixel in a column adjacent to the third column, and wherein the emission pixels are not arranged at the third column.

* * * * *